US009255306B2

(12) United States Patent
Yamasaki et al.

(10) Patent No.: US 9,255,306 B2
(45) Date of Patent: Feb. 9, 2016

(54) STEEL WIRE ROD AND METHOD OF PRODUCING SAME

(75) Inventors: Shingo Yamasaki, Tokyo (JP); Toshiyuki Manabe, Tokyo (JP); Naoshi Hikita, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/004,287

(22) PCT Filed: Mar. 13, 2012

(86) PCT No.: PCT/JP2012/056377

§ 371 (c)(1),
(2), (4) Date: Sep. 10, 2013

(87) PCT Pub. No.: WO2012/124679

PCT Pub. Date: Sep. 20, 2012

(65) Prior Publication Data

US 2014/0000767 A1 Jan. 2, 2014

(30) Foreign Application Priority Data

Mar. 14, 2011 (JP) ..... 2011-056006

(51) Int. Cl.
*C21D 8/06* (2006.01)
*C21D 8/08* (2006.01)
(Continued)

(52) U.S. Cl.
CPC *C21D 8/065* (2013.01); *C21D 8/08* (2013.01); *C21D 9/525* (2013.01); *C22C 1/02* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01);
(Continued)

(58) Field of Classification Search
CPC ... C21D 1/00; C21D 2201/00; C21D 2211/00
USPC ..... 148/546, 330
See application file for complete search history.

(56) References Cited

U.S. PATENT DOCUMENTS 5,211,772 A 5/1993 Ashida et al.
6,783,609 B2 * 8/2004 Hata et al. ..... 148/320
(Continued)

FOREIGN PATENT DOCUMENTS

CN 1251865 10/1999
EP 1277846 1/2003
(Continued)

OTHER PUBLICATIONS

Office Action dated Dec. 4, 2013 issued in corresponding Korean Application No. 10-2012-7033670 [With English Translation].
(Continued)

*Primary Examiner* — Jie Yang
(74) *Attorney, Agent, or Firm* — Kenyon & Kenyon LLP

(57) ABSTRACT

A steel wire rod which is a material of steel wires includes, as a metallographic structure, by area %, 95% to 100% of a pearlite, wherein an average pearlite block size at a central portion of the steel wire rod is 1 μm to 25 μm, an average pearlite block size at a surface layer portion of the steel wire rod is 1 μm to 20 μm, and, when a minimum lamellar spacing of the pearlite at the central portion of the steel wire rod is S in unit of nm and when a distance from a peripheral surface of the steel wire rod to a center is r in unit of mm, $S<12r+65$ is satisfied.

2 Claims, 2 Drawing Sheets

(51) Int. Cl.

| | |
|---|---|
| ***C21D 9/52*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/14*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/10*** | (2006.01) |
| ***C22C 38/12*** | (2006.01) |
| ***C22C 38/16*** | (2006.01) |
| ***C22C 1/02*** | (2006.01) |

(52) U.S. Cl.

CPC ..... *C22C 38/105* (2013.01); *C22C 38/12* (2013.01); *C22C 38/14* (2013.01); *C22C 38/16* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/009* (2013.01)

(56) References Cited

U.S. PATENT DOCUMENTS

| | | | | |
|---|---|---|---|---|
| 8,168,011 | B2 * | 5/2012 | Yamasaki et al. ..... | 148/330 |
| 2009/0151824 | A1 * | 6/2009 | Yamasaki et al. ..... | 148/598 |

FOREIGN PATENT DOCUMENTS

| | | |
|---|---|---|
| EP | 1559805 | 8/2005 |
| EP | 1865079 | 12/2007 |
| EP | 2025769 | 2/2009 |
| JP | 04-346618 | 12/1992 |
| JP | 04-371549 | 12/1992 |
| JP | 06-322480 | 11/1994 |
| JP | 2001-131697 | 5/2001 |
| JP | 2001-181790 | 7/2001 |
| JP | 2001-181793 | 7/2001 |
| JP | 2001-294981 | 10/2001 |
| JP | 2003-193183 | 7/2003 |
| JP | 2004-137597 | 5/2004 |
| JP | 2008-007856 | 1/2008 |
| KR | 10-2001-0102307 | 11/2001 |
| WO | WO 2007001054 A1 * | 1/2007 |

OTHER PUBLICATIONS

International Search Report dated Jun. 5, 2012 issued in corresponding PCT Application No. PCT/JP2012/056377.

Office Action dated Jan. 6, 2014 from corresponding Chinese Application No. CN 201280001811.2 [with English Translation of Search Report].

Search Report dated Oct. 24, 2014 from corresponding European Application No. 12758040.5.

* cited by examiner

STEEL WIRE ROD AND METHOD OF PRODUCING SAME

TECHNICAL FIELD

The present invention relates to a steel wire rod with high strength and excellent ductility and which is a material of steel wires such as a prestressed concrete wire, a zinc-coated steel wire, a spring steel wire, and a bridge cable, and a method of producing the same.

This application is a national stage application of International Application No. PCT/JP2012/056377, filed Mar. 13, 2012, which claims priority to Japanese Patent Application No. 2011-056006, filed on Mar. 14, 2011, an amount of which is incorporated herein by reference.

Priority is claimed on Japanese Patent Application No. 2011-056006, filed on Mar. 14, 2011, an amount of which is incorporated herein by reference.

BACKGROUND ART

Commonly, a steel wire is produced by conducting wire-drawing so as to have a predetermined wire diameter and strength by using a steel wire rod which is produced by hot rolling and patenting treatment conducted as necessary. At a stage of a steel wire rod, when the steel wire rod has low strength, work strain should increase in order to be work-hardened to a predetermined strength during wire-drawing. As a result, a steel wire produced by the wire-drawing has poor ductility. In a case where the steel wire has poor ductility, when the steel wire is torsionally deformed, longitudinal cracking which is called as delamination may occur along a wire-drawing direction of the steel wire at an initial stage of deformation. Once the delamination occurs, stress may be concentrated at a site where the delamination occurs, and fracture of the steel wire may be finally promoted. In order to obtain a steel wire with high strength and excellent ductility by suppressing the occurrence of the delamination in the steel wire, the steel wire rod needs to have high strength and excellent ductility at a stage before the wire-drawing.

Generally, it is known that, when grain size is refined, strength is improved. Similarly, reduction of area (RA) that is an index of ductility of the steel wire rod also depends on austenite grain size. When the austenite grain size is refined, the reduction of area is also improved. Therefore, the austenite grain size of the steel wire rod is to be refined by using carbides or nitrides of Nb, B, and the like as pinning particles.

For example, Patent Document 1 suggests a steel wire rod in which at least one selected from a group consisting of, by mass %, 0.01% to 0.1% of Nb, 0.05% to 0.1% of Zr, and 0.02% to 0.5% of Mo is contained in a high carbon steel wire rod.

In addition, Patent Document 2 suggests a steel wire rod in which the austenite grain size is refined by containing NbC in a high-carbon steel wire rod.

However, in the steel wire rod disclosed in Patent Document 1 and Patent Document 2, expensive elements such as Nb are added, and thus the production cost may increase. Furthermore, since Nb forms coarse carbides and nitrides, these may act as fracture origin, and thus ductility of the steel wire rod may decrease.

Patent Document 3 suggests a method of producing a steel wire rod having high strength and large reduction of area by applying a direct patenting treatment (DLP: Direct in-Line Patenting) without using the expensive elements such as Nb.

In fact, the steel wire rod according to the production method disclosed in Patent Document 3 obtains high strength and large reduction of area without adding the expensive elements. However, at the present time, further improvement in strength and ductility is required. In Patent Document 3, as described in examples thereof, in a case of ensuring tensile strength (TS) of 1200 MPa or more, the reduction of area is less than 45%.

In order to improve properties of the prestressed concrete wire, the zinc-coated steel wire, the spring steel wire, the bridge cable, and the like in which the steel wire rod is used as the materials, it is effective to reduce the diameter of the steel wire rod as small as possible. Since reduction during the wire-drawing is controlled to be small by wire-drawing the steel wire rod with small diameter, the wire-drawn steel wire is controlled to excellent ductility. As a result, the occurrence of the delamination in the steel wire is suppressed. Accordingly, the steel wire rod having the small diameter, high strength, and excellent ductility (that is, large reduction of area) has been anticipated. Specifically, in a case where the diameter is 10 mm or less, a steel wire rod having the tensile strength of 1200 MPa or more and the reduction of area of 45% or more has been anticipated.

RELATED ART DOCUMENTS

Patent Documents

[Patent Document 1] Japanese Unexamined Patent Application, First Publication No. H04-371549

[Patent Document 2] Japanese Unexamined Patent Application, First Publication No. 2001-131697

[Patent Document 3] Japanese Unexamined Patent Application, First Publication No. 2008-007856

SUMMARY OF INVENTION

Technical Problem

In view of the above-mentioned problems, an object of the present invention is to provide a steel wire rod which has higher strength and better ductility than those of the conventional one without adding expensive elements, specifically, tensile strength of 1200 MPa or more and reduction of area of 45% or more, and is to provide a method of producing the same. Particularly, the present invention is to provide the steel wire rod having the tensile strength of 1200 MPa or more and the reduction of area of 45% or more, even when a diameter is 10 mm or less, and is to provide the method of producing the same.

Solution to Problem

An aspect of the present invention employs the following.

(1) A steel wire rod according to an aspect of the invention includes, as a chemical composition, by mass %, 0.70% to 1.00% of C, 0.15% to 0.60% of Si, 0.1% to 1.0% of Mn, 0.001% to 0.005% of N, 0.005% to less than 0.050% of Ni, at least one of 0.005% to 0.10% of Al and 0.005% to 0.10% of Ti, and a balance consisting of iron and unavoidable impurities, and includes, as a metallographic structure, by area %, 95% to 100% of a pearlite, wherein, when a distance from a peripheral surface to a center is r in unit of mm, an average pearlite block size at a central portion which is an area from the center to r×0.99 is 1 μm to 25 μm, wherein an average pearlite block size at a surface layer portion which is an area from the peripheral surface to r×0.01 is 1 μm to 20 μm, and wherein, when a minimum lamellar spacing of the pearlite at the central portion is S in unit of nm, a following Expression 1 is satisfied.

$$S<12r+65 \quad \text{(Expression 1)}$$

(2) The steel wire rod according to (1) may further includes, as the chemical composition, by mass %, at least one of more than 0% to 0.50% of Cr, more than 0% to 0.50% of Co, more than 0% to 0.50% of V, more than 0% to 0.20% of Cu, more than 0% to 0.10% of Nb, more than 0% to 0.20% of Mo, more than 0% to 0.20% of W, more than 0% to 0.0030% of B, more than 0% to 0.0050% of Rare Earth Metal, more than 0.0005% to 0.0050% of Ca, more than 0.0005% to 0.0050% of Mg, and more than 0.0005% to 0.010% of Zr.

(3) In the steel wire rod according to (1) or (2), when a tensile strength is TS in unit of MPa and a reduction of area is RA in unit of %, both of a following Expression 2 and a following Expression 3 may be satisfied.

$$RA \geq 100-0.045\times TS \quad \text{(Expression 2)}$$

$$RA \geq 45 \quad \text{(Expression 3)}$$

(4) In the steel wire rod according to any one of (1) to (3), amounts expressed in mass % of each element in the chemical composition may satisfy a following Expression 4.

$$0.005 \leq Al+Ti \leq 0.1 \quad \text{(Expression 4)}$$

(5) A method of producing a steel wire rod according to an aspect of the invention includes: a casting process to obtain a cast piece consisting of the chemical composition according to (1) or (2); a heating process of heating the cast piece to a temperature of 1000° C. to 1100° C.; a hot-rolling process of hot-finish-rolling the cast piece after the heating process by controlling a finishing temperature to be 850° C. to 1000° C. to obtain a hot-rolled steel; a coiling process of coiling the hot-rolled steel within a temperature range of 780° C. to 840° C.; a patenting process of directly immersing the hot-rolled steel after the coiling process in a molten salt, which is held at a temperature of 480° C. to 580° C., within 15 seconds after the coiling process; and a cooling process of cooling the hot-rolled steel after the patenting process to a room temperature to obtain the steel wire rod.

Advantageous Effects of Invention

According to the above aspects of the present invention, it is possible to obtain a steel wire rod having higher strength (tensile strength of 1200 MPa or more) and better ductility (reduction of area of 45% or more) than those of the conventional one without adding expensive elements. As a result, the steel wire after wire-drawing is controlled to excellent ductility, and thus occurrence of delamination in the steel wire is suppressed. Specifically, it is possible to produce the steel wire which has high strength and in which fracture is suppressed.

In addition, by using the above mentioned steel wire rod, it is possible to conduct the wire-drawing of the steel wire rod which has small diameter (10 mm or less), high strength, and excellent ductility. Accordingly, reduction of the wire-drawing is controlled to be small, and thus the wire-drawn steel wire can be controlled to excellent ductility. As a result, it is possible to improve properties of the steel wires such as the prestressed concrete wire, the zinc-coated steel wire, the spring steel wire, the bridge cable, and the like.

Furthermore, according to the above aspects of the present invention, it is possible to produce the steel wire with high strength and excellent ductility under general hot-rolling conditions as described above. It is not necessary to adopt severe hot-rolling conditions such as large rolling reduction and low rolling temperature in order to produce the steel wire rod with high strength and excellent ductility.

DESCRIPTION OF EMBODIMENTS

Figure 1:
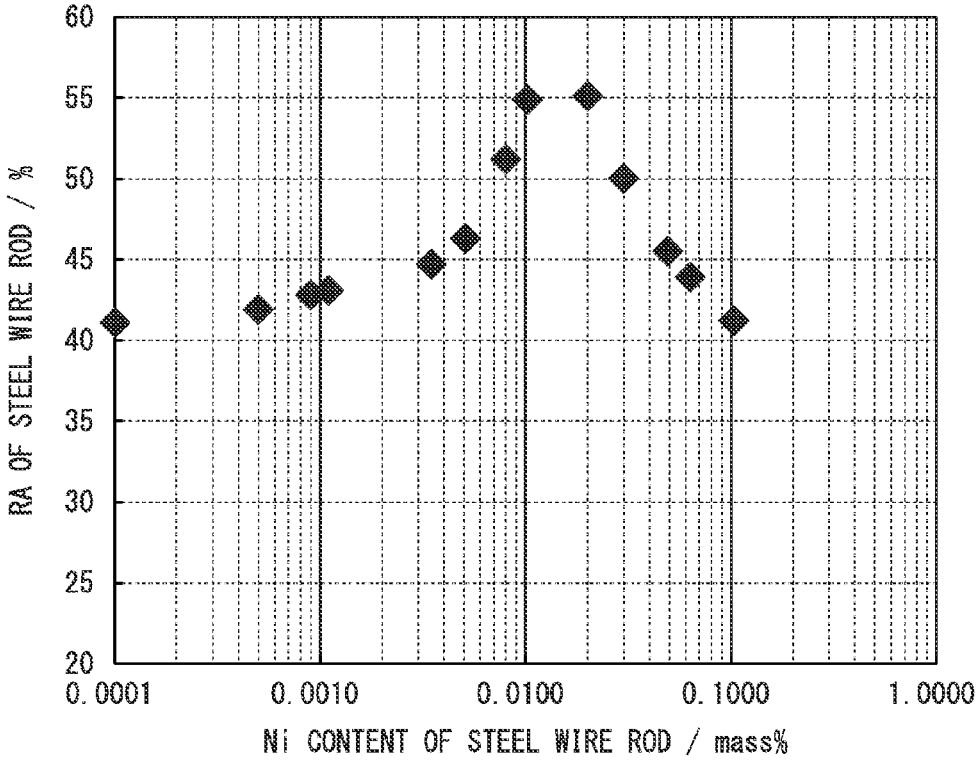
FIG. 1 shows a relationship between Ni content of a steel wire rod and reduction of area of the steel wire rod.

Hereinafter, a preferred embodiment of the present invention will be described in detail. However, the present invention is not limited to the component disclosed in the embodiment, and can employ various modifications as long as the conditions do not depart from the scope of the present invention.

The present inventors have investigated a steel wire rod having higher strength and better ductility than those of the conventional one without adding expensive elements and then found the following results.

First, it is found that the steel wire rod having high strength and excellent ductility can be obtained by adding at least one of Al and Ti which have an effect of suppressing coarsening of austenite grains and by adding a small amount of Ni which has an effect of improving the strength and the ductility only when the addition is the small amount.

The above is derived from the fact that pearlite block size (PBS) is controlled and that lamellar spacing of pearlite is refined in metallographic structure of the steel wire rod. When at least one of Al and Ti is contained, AlN or TiN appropriately precipitates, and thus coarsening of austenite grains is suppressed at a high-temperature region. As a result, the coarsening of the pearlite block size after pearlitic transformation is also suppressed. In addition, when Ni is contained in the small amount, a starting time and a finishing time of the pearlitic transformation during a patenting treatment shift to a longer time side, and thus a pearlitic transformation temperature during production of the steel wire rod substantially decreases. As a result, both of the pearlite block size and the lamellar spacing are refined. By the above effects the steel wire rod obtains high strength and excellent ductility.

In addition, it is found that, as a production method, controlling a time after a coiling process of coiling hot-rolled steel and before a patenting process to be very short is effective.

When the time after the coiling process and before the patenting process is controlled to be very short, the austenite is preferentially transformed to the pearlite in the metallographic structure, and thus the steel wire rod having a small fraction of non-pearlite structure can be obtained. A non-pearlite structure such as upper bainite, pro-eutectoid ferrite, degenerate pearlite, and pro-eutectoid cementite is a factor deteriorating properties of the steel wire rod. When the fraction of the non-pearlite structure is controlled to be a small value and a fraction of the pearlite is controlled to be large, the steel wire rod obtains high strength and excellent ductility.

Hereinafter, limitation range and reasons for the limitation of base elements of the steel wire rod according to the embodiment will be described. In addition, % as described below is mass %.

C: 0.70% to 1.00%

C (carbon) is an element that increases the strength. When an amount of C is less than 0.70%, the strength is insufficient, and it is difficult to obtain uniform pearlite structure because precipitation of the pro-eutectoid ferrite to austenite grain boundaries is promoted. On the other hand, when the amount of C is more than 1.00%, the pro-eutectoid cementite is easily formed at a surface layer portion of the steel wire rod, reduction of area of the steel wire rod at fracture decreases, and thus the fracture of wire at wire-drawing tends to occur. Accordingly, the amount of C is to be 0.70% to 1.00%. The amount of C is preferably 0.70% to 0.95%, and is more preferably 0.70% to 0.90%.

Si: 0.15% to 0.60%

Si (silicon) is an element that increases the strength, and is a deoxidizing element. When an amount of Si is less than 0.15%, the effects may not be obtained. On the other hand, when the amount of Si is more than 0.60%, the ductility of the steel wire rod decreases, the precipitation of the pro-eutectoid ferrite is promoted in hyper-eutectoid steel, and it is difficult to remove surface oxide by mechanical descaling. Accordingly, the amount of Si is to be 0.15% to 0.60%. The amount of Si is preferably 0.15% to 0.35%, and is more preferably 0.15% to 0.32%.

Mn: 0.10% to 1.00%

Mn (manganese) is a deoxidizing element, and is an element that increases the strength. Furthermore, Mn is an element that suppresses hot embrittlement by fixing S in steel as MnS. When an amount of Mn is less than 0.10%, the effects may not be obtained. On the other hand, when the amount of Mn is more than 1.00%, Mn segregates to a central portion of the steel wire rod, martensite or bainite is formed at the segregated portion, and thus the reduction of area and drawability decrease. Accordingly, the amount of Mn is to be 0.10% to 1.00%. The amount of Mn is preferably 0.10% to 0.80%.

N: 0.001% to 0.005%

N (nitrogen) is an element that suppresses the coarsening of austenite grains at a high-temperature region by forming nitrides in steel. When an amount of N is less than 0.001%, the effect may not be obtained. On the other hand, when the amount of N is more than 0.005%, since the amount of nitrides excessively increases and the nitrides act as a fracture origin, the ductility of the steel wire rod may decrease. In addition, solid-soluted N in steel may promote age hardening after the wire-drawing. Accordingly, the amount of N is to be 0.001% to 0.005%. The amount of N is preferably 0.001% to 0.004%.

Ni: 0.005% to less than 0.050%

Ni (nickel) is an element that improves the ductility of steel by solid-soluted in steel. In addition, Ni is an element that suppresses the pearlitic transformation and shifts the starting time and the finishing time of the pearlitic transformation during the patenting treatment to the longer time side. Therefore, in a case where a cooling rate is the same, a temperature further decreases before starting the pearlitic transformation in the patenting treatment in steel which contains Ni as compared with steel which does not contain Ni. The above indicates that the transformation temperature of the pearlitic transformation substantially is to be a lower temperature. As a result, both of the pearlite block size and the lamellar spacing of pearlite are refined. The reduction of area of the steel wire rod is improved with refining the pearlite block size, and the strength of the steel wire rod is improved with refining the lamellar spacing of the pearlite.

When an amount of Ni is less than 0.005%, the effects may not be obtained. On the other hand, when the amount of Ni is 0.050% or more, the pearlitic transformation is excessively suppressed, the austenite remains in the metallographic structure of the steel wire rod during the patenting treatment, and thus a large amount of micro-martensite is formed in the metallographic structure of the steel wire rod after the patenting treatment. As a result, the reduction of area of the steel wire rod decreases. FIG. 1 shows a relationship between Ni content of the steel wire rod and the reduction of area of the steel wire rod. As shown in the figure, when Ni content is 0.005% to less than 0.050%, the effect of improving the reduction of area of the steel wire rod is obtained. The amount of Ni is preferably 0.005% to 0.030%. In addition, approximately 0.0005% of Ni is unavoidably contained under ordinary producing conditions.

Al: 0.005% to 0.10%

Al (aluminum) is a deoxidizing element. In addition, Al is an element that precipitates as AlN by bonding to N. AlN has the effects of suppressing the coarsening of austenite grains at the high-temperature region and of suppressing the age hardening after the wire-drawing by reducing the solid-soluted N in steel. When the coarsening of austenite grains at the high-temperature region is suppressed, the pearlite block size in the metallographic structure of the steel wire rod after the patenting treatment is refined. As a result, the reduction of area of the steel wire rod is improved. When an amount of Al is less than 0.005%, the effects may not be obtained. On the other hand, when the amount of Al is more than 0.10%, a large amount of alumina-based non-metallic inclusions which are hard and undeformable are formed, and thus the ductility of the steel wire rod decreases. Therefore, the amount of Al is to be 0.005% to 0.10%. The amount of Al is preferably 0.005% to 0.050%.

Ti: 0.005% to 0.10%

Similarly to Al, Ti (titanium) is a deoxidizing element. In addition, similarly to Al, Ti is an element that precipitates as TiN by bonding to N. TiN has the effects of suppressing the coarsening of austenite grains at the high-temperature region and of suppressing the age hardening after the wire-drawing by reducing the solid-soluted N in steel. The pearlite block size in the metallographic structure of the steel wire rod after the patenting treatment is refined due to TiN, and as a result, the reduction of area of the steel wire rod is improved. When an amount of Ti is less than 0.005%, the effects may not be obtained. On the other hand, when the amount of Ti is more than 0.1%, coarse carbides are formed in the austenite, and thus the ductility may decrease. Therefore, the amount of Ti is to be 0.005% to 0.10%. The amount of Ti is preferably 0.005% to 0.050%, and is more preferably 0.005% to 0.010%.

As described above, Al and Ti have the same operation and effect. Accordingly, since Al precipitates as AlN by bonding to N in a case where Al is contained, the effects may be obtained even when Ti is not added. Similarly, since Ti precipitates as TiN by bonding to N in a case where Ti is contained, the effects may be obtained even when Al is not added. Therefore, at least one of Al and Ti may be contained. In a case where both of Al and Ti are contained, it is preferable that amounts expressed in mass % of each element satisfy a following Expression A. When a lower limit of the Expression A is less than 0.005, the effects may not be obtained. On the other hand, when an upper limit of the following Expression A is more than 0.10, the alumina-based non-metallic inclusions or Ti-based carbides are excessively formed, and thus the ductility of the steel wire rod decreases. The upper limit of the following Expression A is preferably 0.05% or less.

$$0.005 \leq Al+Ti \leq 0.10 \quad \text{(Expression A)}$$

In addition to the above mentioned base elements, the steel wire rod according to the embodiment includes unavoidable impurities. Herein, the unavoidable impurities indicate elements such as P, S, O, Pb, Sn, Cd, and Zn which contaminate unavoidably from auxiliary materials such as scrap and the like and from producing processes. In the elements, P, S, and O may be limited to the following in order to preferably obtain the effect. In addition, % as described below is mass %. Moreover, although a limited range of the unavoidable impurities includes 0%, it is industrially difficult to be stably 0%.

P: 0.020% or less

P (phosphorous) is an impurity and is an element that causes intergranular fracture by segregating to the austenite grain boundaries and by embrittling prior-austenite grain boundaries. When an amount of P is more than 0.02%, the influence may be promoted. Accordingly, it is preferable that the amount of P be limited to 0.02% or less. Since it is preferable that P content is as small as possible, the limited range includes 0%. However, it is not technically easy to control P content to be 0%, and also the production cost of the steel may increase in order to be stably less than 0.001%. Thus, preferable limited range of P content is 0.001% to 0.020%. More preferable limited range of P content is 0.001% to 0.015%. Generally, in ordinary producing conditions, P of approximately 0.020% is contained unavoidably.

S: 0.020% or less

S (sulfur) is an impurity and is an element that forms the sulfides. When an amount of S is more than 0.02%, coarse sulfides are formed, and thus the ductility of the steel wire rod may decrease. Accordingly, it is preferable that the amount of S be limited to 0.020% or less. Since it is preferable that S content is as small as possible, the limited range includes 0%. However, it is not technically easy to control S content to be 0%, and also the production cost of the steel may increase in order to be stably less than 0.001%. Thus, preferable limited range of S content is 0.001% to 0.020%. More preferable limited range of S content is 0.001% to 0.015%. Generally, in ordinary producing conditions, S of approximately 0.020% is contained unavoidably.

O: 0.0030% or less

O (oxygen) is an unavoidably contained impurity and an element that forms oxide-based inclusions. When an amount of O is more than 0.0030%, coarse oxides are formed, and thus the ductility of the steel wire rod may decrease. Accordingly, it is preferable that the amount of O be limited to 0.0030% or less. Since it is preferable that O content is as small as possible, the limited range includes 0%. However, it is not technically easy to control O content to be 0%, and also the production cost of the steel may increase in order to be stably less than 0.00005%. Thus, preferable limited range of O content is 0.00005% to 0.0030%. More preferable limited range of O content is 0.00005% to 0.0025%. Generally, in ordinary producing conditions, O of approximately 0.0035% is contained unavoidably.

In addition to the above mentioned base elements and impurities, the steel wire rod according to the embodiment may further include, as optional elements, at least one of Cr, Co, V, Cu, Nb, Mo, W, B, REM, Ca, Mg, and Zr. Hereinafter, limitation range and reasons for the limitation of the optional elements will be described. In addition, % as described below is mass %.

Cr: more than 0% to 0.50%

Cr (chromium) is an element that refines the lamellar spacing of pearlite and improves the strength of the steel wire rod. In order to obtain the effects, it is preferable that an amount of Cr be more than 0% to 0.5%. The amount of Cr is more preferably 0.0010% to 0.50%. When the amount of Cr is more than 0.50%, the pearlitic transformation may be excessively suppressed, the austenite may remain in the metallographic structure of the steel wire rod during the patenting treatment, and thus supercooled structure such as the martensite and the bainite may be formed in the metallographic structure of the steel wire rod after the patenting treatment. In addition, it may be difficult to remove the surface oxides by the mechanical descaling.

Co: more than 0% to 0.50%

Co (cobalt) is an element that suppresses the precipitation of the pro-eutectoid cementite. In order to obtain the effect, it is preferable that an amount of Co be more than 0% to 0.50%. The amount of Co is more preferably 0.0010% to 0.50%. When the amount of Co is more than 0.50%, the effect may be saturated, and the cost for the addition may be vain.

V: more than 0% to 0.50%

V (vanadium) is an element that suppresses the coarsening of austenite grains at the high-temperature region by forming fine carbonitrides and that increases the strength of the steel wire rod. In order to obtain the effects, it is preferable that an amount of V be more than 0% to 0.50%. The amount of V is more preferably 0.0010% to 0.50%. When the amount of V is more than 0.50%, an amount of the formed carbonitrides may increase, a size of the carbonitrides may also increase, and thus the ductility of the steel wire rod may decrease.

Cu: more than 0% to 0.20%

Cu (copper) is an element that increases corrosion resistance. In order to obtain the effect, it is preferable that an amount of Cu be more than 0% to 0.20%. The amount of Cu is more preferably 0.0001% to 0.20%. When the amount of Cu is more than 0.20%, Cu and may segregate as CuS in the grain boundaries by reacting with S, the ductility of the steel wire rod may decrease, and defects may occur in the steel wire rod.

Nb: more than 0% to 0.10%

Nb (niobium) has an effect of increasing corrosion resistance. In addition, Nb is an element that suppresses the coarsening of austenite grains at the high-temperature region by forming carbides or nitrides. In order to obtain the effects, it is preferable that an amount of Nb be more than 0% to 0.10%. The amount of Nb is more preferably 0.0005% to 0.10%. When the amount of Nb is more than 0.1%, the pearlitic transformation may be suppressed during the patenting treatment.

Mo: more than 0% to 0.20%

Mo (molybdenum) is an element that concentrates at a growth interface of the pearlite and suppresses growth of the pearlite due to so-called solute drag effect. In addition, Mo is an element that suppresses formation of the ferrite and reduces the non-pearlite structure. In order to obtain the effects, it is preferable that an amount of Mo be more than 0% to 0.20%. The amount of Mo is more preferably 0.0010% to 0.20% and further more preferably 0.005% to 0.06%. When the amount of Mo is more than 0.20%, the growth of the pearlite may be suppressed, it may take a long time for the patenting treatment, and a decrease in productivity may occur. In addition, when the amount of Mo is more than 0.20%, coarse $Mo_2C$ carbides may precipitate, and thus the drawability may decrease.

W: more than 0% to 0.20%

Similarly to Mo, W (tungsten) is an element that concentrates at the growth interface of the pearlite and suppresses the growth of the pearlite due to the so-called solute drag effect. In addition, W is an element that suppresses the formation of the ferrite and reduces the non-pearlite structure. In order to obtain the effects, it is preferable that an amount of W be more than 0% to 0.20%. The amount of W is more preferably 0.0005% to 0.20% and further more preferably 0.005% to 0.060%. When the amount of W is more than 0.2%, the growth of the pearlite may be suppressed, it may take a long time for the patenting treatment, and the decrease in productivity may occur. In addition, when the amount of W is more than 0.20%, coarse $W_2C$ carbides may precipitate, and thus the drawability may decrease.

B: more than 0% to 0.0030%

B (boron) is an element that suppresses the formation of the non-pearlite precipitates such as the ferrite, the degenerate pearlite, and the bainite. In addition, B is an element that forms carbides or nitrides, and suppresses the coarsening of austenite grains at the high-temperature region. In order to obtain the effects, it is preferable that an amount of B be more than 0% to 0.0030%. The amount of B is more preferably 0.0004% to 0.0025%, further more preferably 0.0004% to 0.0015%, and most preferably 0.0006% to 0.0012%. When the amount of B is more than 0.0030%, precipitation of coarse $Fe_{23}(CB)_6$ carbides may be promoted, and the ductility may decrease.

REM: more than 0% to 0.0050%

REM (Rare Earth Metal) is a deoxidizing element. In addition, REM is an element that detoxifies S which is the impurity by forming sulfides. In order to obtain the effects, it is preferable that an amount of REM be more than 0% to 0.0050%. The amount of REM is more preferably 0.0005% to 0.0050%. When the amount of REM is more than 0.0050%, coarse oxides may be formed, the ductility of the steel wire rod may decrease, and the fracture of the wire during the wire-drawing may occur.

Herein, REM indicate a generic name of a total of 17 elements in which scandium of the atomic number 21 and yttrium of the atomic number 39 are added to 15 elements from lanthanum of the atomic number 57 to lutetium of the atomic number 71. In general, misch metal which is a mixture of the elements is supplied and added to the steel.

Ca: more than 0.0005% to 0.0050%

Ca (calcium) is an element that reduces alumina-based hard inclusions. In addition, Ca is an element that precipitates as fine oxides. As a result, the pearlite block size of the steel wire rod is refined, and thus the ductility of the steel wire rod is improved. In order to obtain the effects, it is preferable that an amount of Ca be more than 0.0005% to 0.0050%. The amount of Ca is more preferably 0.0005% to 0.0040%. When the amount of Ca is more than 0.0050%, coarse oxides may be formed, the ductility of the steel wire rod may decrease, and thus the fracture of the wire during the wire-drawing may occur. Generally, in ordinary producing conditions, Ca of approximately 0.0003% is contained unavoidably.

Mg: more than 0.0005% to 0.0050%

Mg (magnesium) is an element that precipitates as fine oxides. As a result, the pearlite block size of the steel wire rod is refined, and thus the ductility of the steel wire rod is improved. In order to obtain the effects, it is preferable that an amount of Mg be more than 0.0005% to 0.0050%. The amount of Mg is more preferably 0.0005% to 0.0040%. When the amount of Mg is more than 0.0050%, coarse oxides may be formed, the ductility of the steel wire rod may decrease, and thus the fracture of the wire during the wire-drawing may occur. Generally, in ordinary producing conditions, Mg of approximately 0.0001% is contained unavoidably.

Zr: more than 0.0005% to 0.010%

Zr (zirconium) is an element that improves a fraction of equiaxial austenite and refines the austenite grains, because Zr is crystallized as ZrO which acts as nuclei of the austenite. As a result, the pearlite block size of the steel wire rod is refined, and thus the ductility of the steel wire rod is improved. In order to obtain the effects, it is preferable that an amount of Zr be more than 0.0005% to 0.010%. The amount of Zr is more preferably 0.0005% to 0.0050%. When the amount of Zr is more than 0.010%, coarse oxides may be formed, and thus the fracture of the wire during the wire-drawing may occur.

Next, the metallographic structure of the steel wire rod according to the embodiment will be described.

The steel wire rod according to the embodiment includes, the metallographic structure, by area %, 95% to 100% of the pearlite. When a distance from a peripheral surface to a center of the steel wire rod is defined as r in a unit of mm, an average pearlite block size at a central portion which is an area from the center of the steel wire rod to r×0.99 is 1 μm to 25 μm. An average pearlite block size at a surface layer portion which is an area from the peripheral surface of the steel wire rod to r×0.01 is 1 μm to 20 μm. When a minimum lamellar spacing of the pearlite at the central portion is defined as S in a unit of nm, a following Expression B is satisfied.

$$S<12r+65 \quad \text{(Expression B)}$$

Pearlite: 95% to 100%

When 95% to 100% of the pearlite is contained in the metallographic structure, a fraction of the non-pearlite structure such as the upper bainite, the pro-eutectoid ferrite, the degenerate pearlite, and the pro-eutectoid cementite decreases, and thus the strength and the ductility of the steel wire rod is improved. Although it is ideal that the non-pearlite structure is completely suppressed by controlling the pearlite in the metallographic structure to be 100%, in fact it is not necessary that the non-pearlite structure is reduced to zero. In a case where 95% to 100% of pearlite is contained in the metallographic structure, the strength and the ductility of the steel wire rod is sufficiently improved.

The metallographic structure of the steel wire rod may be observed by using a SEM (Scanning Electron Microscope) after subjecting a sample to chemical etching with picric acid. An observed section may be a cross-section (L cross-section) which is parallel to a longitudinal direction of the steel wire rod, metallographic micrographs of at least five visual fields may be taken by the SEM at a magnification of 2000-fold, and an average value of the fraction of the pearlite may be determined by an image analysis.

Average pearlite block size at central portion of steel wire rod: 1 μm to 25 μm

Figure 2:
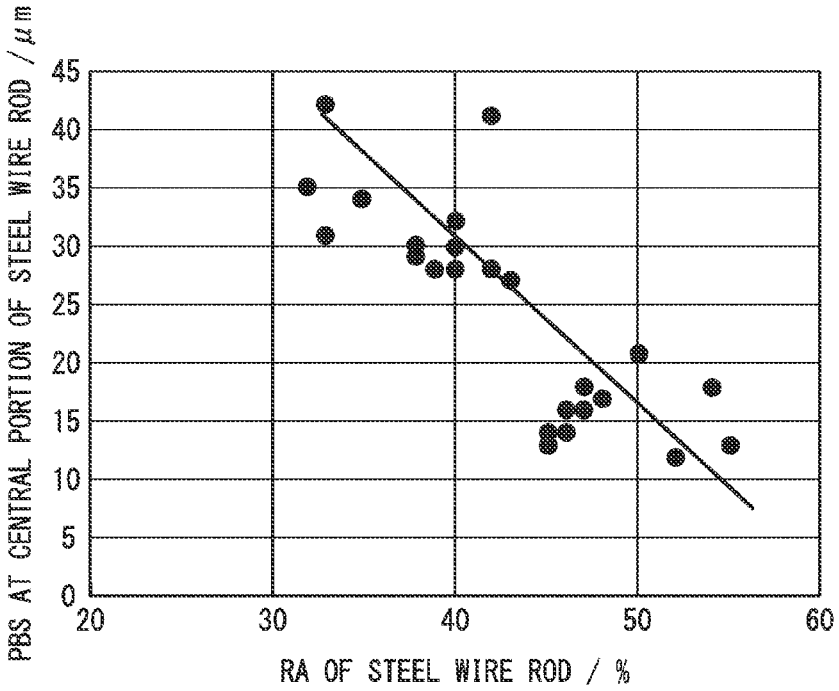
FIG. 2 shows a relationship between the reduction of area of the steel wire rod and an average pearlite block size in metallographic structure at a central portion of the steel wire rod.

The pearlite block size (PBS) is a factor affecting the ductility of the steel wire rod or the ductility of the steel wire after the wire-drawing. When the austenite grains are refined at the high-temperature region or the pearlitic transformation temperature during the patenting treatment is a low temperature, the PBS is refined. In addition, the ductility of the steel wire rod is improved. FIG. 2 shows a relationship between the reduction of area of the steel wire rod and the average pearlite block size in the metallographic structure of the central portion of the steel wire rod. As shown in the figure, in order to sufficiently increasing and controlling the reduction of area of the steel wire rod to be 45% or more, it is necessary for the average PBS at the central portion of the steel wire rod to be 25 μm or less. The average PBS at the central portion of the steel wire rod is preferably 20 μm or less and more preferably 15 μm or less. In addition, although it is preferable that the PBS at the central portion of the steel wire rod is as fine as possible, the above-described properties of the steel wire rod are satisfied as long as the average PBS is 1 μm or more.

Average pearlite block size at surface layer portion of steel wire rod: 1 μm to 20 μm The surface layer portion of the steel wire rod is a region at which delamination occurs when the steel wire is torsionally deformed. In order to suppress occurrence of the delamination of the steel wire by sufficiently increasing the drawability of the steel wire rod, the PBS at the surface layer portion of the steel wire rod is refined as compared with that at the central portion of the steel wire rod. Accordingly, it is necessary for the average PBS at the surface layer portion of the steel wire rod to be 20 μm or less. The average PBS at the surface layer portion of the steel wire rod is preferably 15 μm or less and more preferably 10 μm or less. In addition, although it is preferable that the PBS at the surface layer portion of the steel wire rod is as fine as possible, the above-described properties of the steel wire rod are satisfied as long as the average PBS is 1 μm or more.

The pearlite block size of the steel wire rod may be determined by using an EBSD (Electron BackScatter Diffraction Pattern) method. The L cross-section of the steel wire rod which is embedded in resin may be cut and polished, EBSD measurement may be conducted in at least three visual fields which are 150 μm×250 μm at the central portion and the surface layer portion of the steel wire rod, and the average pearlite block size may be determined by the analysis with a method of Johnson-Saltykov in which a region surrounded by boundaries having a misorientation of 9° is regarded as one block.

Minimum Lamellar Spacing s of Pearlite at Central Portion of Steel Wire Rod

Figure 3:
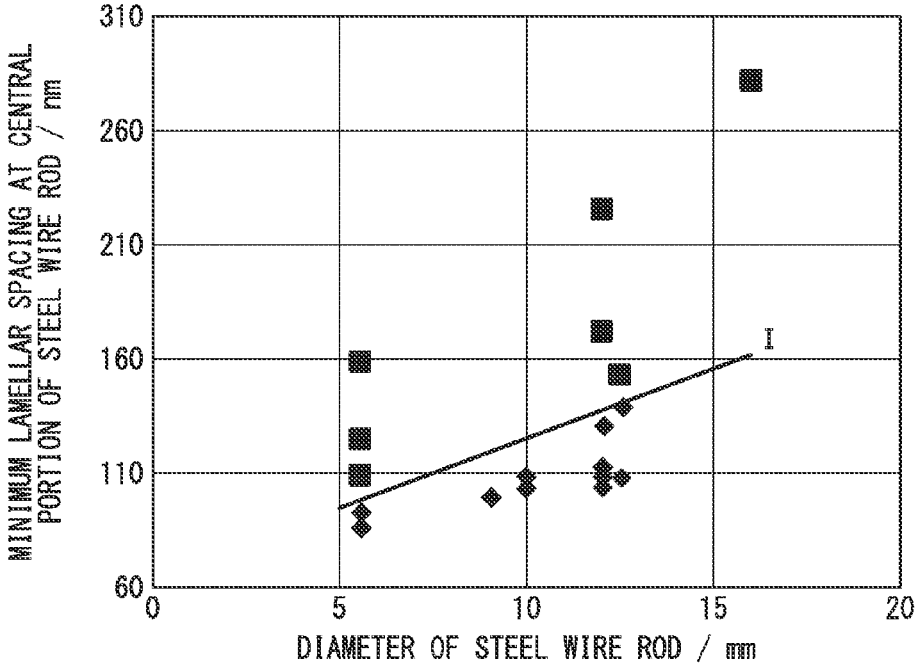
FIG. 3 shows a relationship between a diameter of the steel wire rod and a minimum lamellar spacing of pearlite in the metallographic structure at the central portion of the steel wire rod.

The lamellar spacing is a factor affecting the strength of the steel wire rod or the strength of the steel wire after the wire-drawing. When the pearlitic transformation temperature during the patenting treatment is a low temperature, the lamellar spacing is refined. In addition, the strength of the steel wire rod increases. Accordingly, the lamellar spacing can be controlled by adjusting the alloy elements and by changing the pearlitic transformation temperature. In addition, a diameter of the steel wire rod also affects the lamellar spacing. Since the cooling rate of the steel wire rod after hot rolling increases with reducing the diameter of the steel wire rod, the lamellar spacing is refined. FIG. 3 shows a relationship between the diameter of the steel wire rod and the minimum lamellar spacing S of the pearlite in the metallographic structure at the central portion of the steel wire rod. In the figure, results of the steel wire rods, which satisfy the chemical composition and the metallographic structure as mentioned above, are shown as a rhombus, and results of conventional steel wire rods are shown as a quadrangle. In addition, in the figure, S=12r+65 is indicated by a straight line I. As can be seen from the figure, the minimum lamellar spacing S of the steel wire rod, which satisfies the chemical composition and the metallographic structure, is smaller than the minimum lamellar spacing S of the conventional steel wire rod in any diameter by using the straight line I as a border. Specifically, the minimum lamellar spacing S of the steel wire rod according to the embodiment satisfies the above-described Expression B (S<12r+65). As a result, the strength of the steel wire rod further increases as compared with the conventional steel wire rod.

The minimum lamellar spacing S of the pearlite of the steel wire rod may be observed by using the SEM. An observed section may be a cross-section (C cross-section) which is orthogonal to the longitudinal direction of the steel wire rod, the observed section which is embedded in resin may be cut and polished, metallographic micrographs of at least five visual fields at the central portion of the steel wire rod may be taken by the SEM at a magnification of 10000-fold, the minimum lamellar spacing in the visual fields may be measured, and then an average value thereof may be determined.

Figure 4:
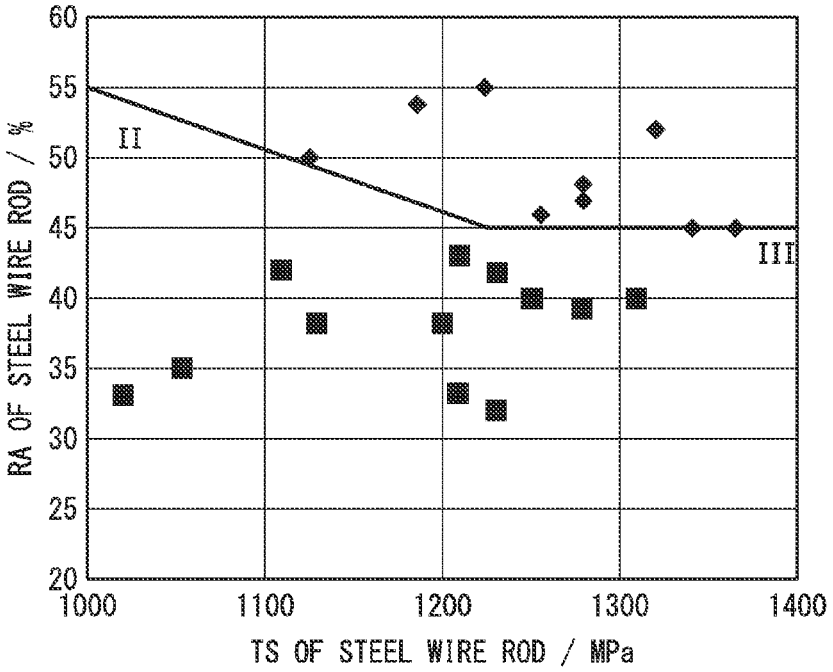
FIG. 4 shows a relationship between tensile strength of the steel wire rod and the reduction of area of the steel wire rod.

In addition, in the steel wire rod according to the embodiment, when tensile strength is defined as TS in a unit of MPa and the reduction of area is defined as RA in a unit of %, it is preferable that both of a following Expression C and a following Expression D are satisfied. Generally, it is known that the reduction of area RA is inversely proportional to the tensile strength TS. As described above, a steel wire rod having the reduction of area of 45% or more has been anticipated at present. In addition, in a case of a steel wire rod in which severe tensile strength TS is not required, it is preferable that the reduction of area RA be further larger than 45%. FIG. 4 shows a relationship between the tensile strength of the steel wire rod and the reduction of area of the steel wire rod. In the figure, results of the above-described steel wire rod are shown as a rhombus, and results of the conventional steel wire rod are shown as a quadrangle. In addition, in the figure, RA=100−0.045×TS is indicated by a straight line II, and RA=45 is indicated by a straight line III. As can be seen from the figure, the value of the reduction of area RA of the steel wire rod is larger than that of the conventional steel wire rod by using the straight line II and the straight line III as a border. As mentioned above, it is preferable that the value of the reduction of area RA increases as a function of the value of the tensile strength TS so as to satisfy the following Expression C and the following Expression D. In addition, RA>46 is preferable, RA>48 is more preferable, and RA>50 is most preferable. Although an upper limit of the reduction of area RA is not particularly limited, the wire-drawing can be sufficiently conducted in general when the reduction of area RA is 60%. Accordingly, the upper limit of the reduction of area RA may be 60%.

$$RA \geq 100 - 0.045 \times TS \quad \text{(Expression C)}$$

$$RA \geq 45 \quad \text{(Expression D)}$$

When the steel wire rod satisfies the above-described chemical composition and metallographic structure, the steel wire rod having higher strength and better ductility than those of the conventional one may be obtained. In order to obtain the steel wire rod having the metallographic structure, the steel wire rod may be produced by the following production method.

Next, the method of producing the steel wire rod according to the embodiment will be described.

In a casting process, molten steel which consists of the base elements, the optional elements, and the unavoidable impurities as described above is casted to obtain a cast piece. Although a casting method is not limited particularly, a vacuum casting method, a continuous casting method, and the like may be employed.

In addition, according to the necessity, a soaking, a blooming, and the like may be conducted by using the cast piece after the casting process.

In a heating process, the cast piece after the casting process is heated to a temperature of 1000° C. to 1100° C. The reason why the cast piece is heated to the temperature range of 1000° C. to 1100° C. is to allow the metallographic structure of the cast piece to be the austenite. When the temperature is lower than 1000° C., transformation from the austenite to another structure may occur during the hot rolling that is a subsequent process. When the temperature is higher than 1100° C., austenite grains may grow and coarsen.

In the hot-rolling process, the cast piece after the heating process is hot-finish-rolled so as to control a finishing rolling temperature to be 850° C. to 1000° C. in order to obtain hot-rolled steel. Here, the finish-rolling indicates rolling of a final pass in the hot-rolling process in which plural passes of the hot rolling are conducted. The reason why the finishing rolling temperature is the temperature range of 850° C. to 1000° C. is to control the pearlite block size (PBS). When the finishing rolling temperature is lower than 850° C., transformation from the austenite to another structure may occur during the hot rolling. When the finishing rolling temperature is higher than 1000° C., it is difficult to control a temperature in subsequent processes, and thus the PBS may not be controlled. In addition, it is preferable that rolling reduction in the finish rolling be 10% to less than 60%. When the rolling reduction in the finish rolling is 10% or more, an effect of refining the austenite grains may be appropriately obtained. On the other hand, when the rolling reduction in the finish rolling is 60% or more, load on production facilities may be excessive, and the production cost may increase.

In a coiling process, the hot-rolled steel after the hot-rolling process is coiled within a temperature range of 780° C. to 840° C. The reason why the coiling temperature range is 780° C. to 840° C. is to control the PBS. When the coiling temperature is lower than 780° C., the pearlitic transformation tends to start only at the surface layer portion that is easily cooled. When the coiling temperature is higher than 840° C., unevenness in the PBS may increase due to a difference in the cooling rate between an overlapped portion and a non-overlapped portion during the coiling. The upper limit of the coiling temperature is preferably lower than 800° C. in order to refine the PBS and increase the reduction of area of the steel wire rod.

In a patenting process, within 15 seconds after the coiling process, the hot-rolled steel after the coiling process is directly immersed in a molten salt (DLP) which is held at a temperature of 480° C. to 580° C. The reason why the hot-rolled steel is isothermally maintained at the temperature range of 480° C. to 580° C. within 15 seconds after the coiling process is to preferentially progress the pearlitic transformation. As a result, it is possible to obtain the metallographic structure having the small fraction of the non-pearlite structure. When the temperature of the molten salt is lower than 480° C., the upper bainite which is soft increases, and thus the strength of the steel wire rod is not improved. On the other hand, when the temperature of the molten salt is higher than 580° C., the temperature is high for the pearlitic transformation temperature, the PBS coarsens, and the lamellar spacing also coarsens. In addition, when longer than 15 seconds, the austenite grain size may coarsen, and the fraction of the non-pearlite structure may increase due to the formation of the pro-eutectoid cementite and the like. It is preferable that the immersion is conducted within 10 seconds. Although it is ideal that a lower limit of the number of seconds is 0 seconds, in fact it is preferable that the lower limit is 2 seconds or longer.

In a cooling process, the hot-rolled steel which has been subjected to the patenting treatment and in which the pearlitic transformation has been finished is cooled to room temperature after the patenting process in order to the steel wire rod. The steel wire rod has the above-described metallographic structure.

EXAMPLE

Hereinafter, the effects of an aspect of the present invention will be described in detail with reference to the following examples. However, the condition in the examples is an example condition employed to confirm the operability and the effects of the present invention, so that the present invention is not limited to the example condition. The present invention can employ various types of conditions as long as the conditions do not depart from the scope of the present invention and can achieve the object of the present invention.

Sample Preparation

Examples 1 to 48 and Comparative Examples 49 to 85 with the chemical composition shown in Tables 1 and 2 were casted into cast piece having a shape of 300 mm×500 mm by using a continuous casting machine (casting process). The cast piece was subject to blooming to a shape of a cross-section of 122 mm square. The steel piece (cast piece) was heated to 1000° C. to 1100° C. (heating process). After the heating, finish rolling was conducted so that a finishing rolling temperature was 850° C. to 1000° C., whereby hot-rolled steel having a wire rod diameter (diameter) shown in Tables 3 and 4 was obtained (hot rolling process). The hot-rolled steel was coiled at 780° C. to 840° C. (coiling process). After the coiling, a patenting treatment was conducted (patenting process). Some of the hot-rolled steels were subject to the patenting treatment by immersed in a salt bath held at 480° C. to 580° C. within 15 seconds after the coiling. After the patenting treatment, cooling to room temperature was conducted to obtain steel wire rod (cooling process). In Tables 1 to 4, the underlined value indicates out of the range of the present invention. In Table 1, the blank column indicates that the optional element was not intentionally added.

In addition, wire-drawing was conducted by using the produced steel wire rod. In the wire-drawing, scale of the steel wire rod was removed by pickling, a zinc phosphate film was applied by phosphating, the wire-drawing in which reduction per a pass was 10% to 25% was conducted by using a die having an approach angle of 10°, and whereby a high strength steel wire having a diameter of 1.5 mm to 4.5 mm was obtained. Work strain during the wire-drawing and the wire diameter (diameter) of the steel wire after the wire-drawing are shown in Tables 3 and 4.

Evaluation

Area Fraction of Pearlite

The steel wire rod was embedded in resin and was polished. The steel wire rod was subjected to chemical etching using picric acid and was observed by using a SEM. An observed section was a cross-section (L cross-section) which is parallel to a longitudinal direction of the steel wire rod. In addition, grain boundary ferrite, bainite, pro-eutectoid cementite, and micromartensite were regarded as a non-pearlite structure, and a fraction of the balance was regarded as the area fraction of pearlite. Evaluation of the area fraction of pearlite was conducted by SEM-observing total five areas including, when the diameter of the steel wire rod was defined as D in a unit of mm, total four areas which were obtained by rotating a ¼D region in the L cross-section of the steel wire rod by 90° around the center of the steel wire rod and one area which was the center of the steel of a ½D region in the L cross-section of the steel wire rod. In the SEM observation, metallographic micrographs with a visual field of vertically 100 μm×horizontally 200 μm were taken at a magnification of 2000-fold, and an average value of the area fraction of pearlite was determined by an image analysis of the metallographic micrographs. A case in which the pearlite was 95% to 100% in a unit of area % was judged to be acceptable.

Average Pearlite Block Size

A pearlite block size (PBS) of the steel wire rod was determined by using an EBSD method. The L cross-section of the steel wire rod was embedded in resin and was polished. When a distance from a peripheral surface to the center of the steel wire rod was r in a unit of mm, a central portion was an area from the center of the steel wire rod to r×0.99, and a surface layer portion was an area from the peripheral surface of the steel wire rod to r×0.01, the central portion and the surface layer portion were evaluated. EBSD measurement was conducted in at least three visual fields which were 150 μm×250 μm at the central portion and the surface layer portion of the steel wire rod, and an average pearlite block size was determined by the analysis with a method of Johnson-Saltykov in which a region surrounded by boundaries having a misorientation of 9° was regarded as one block. A case in which the average pearlite block size at the central portion was 1 μm to 25 μm and a case in which the average pearlite block size at the surface layer portion was 1 μm to 20 μm were judged to be acceptable.

Minimum Lamellar Spacing

A minimum lamellar spacing S at the central portion of the steel wire rod was observed by using the SEM. An observed section was a cross-section (C cross-section) which was orthogonal to the longitudinal direction of the steel wire rod. Metallographic micrographs of at least five visual fields at the central portion of the steel wire rod were taken by the SEM at a magnification of 10000-fold, the minimum lamellar spacing in the visual fields was measured, and then an average value thereof was determined. A case in which the r that is a distance from the peripheral surface to the center of the steel wire rod and the S satisfied $S<12r+65$ was judged to be acceptable.

Mechanical Properties

Test specimens having a gauge length of 200 mm were prepared so that the longitudinal direction of the steel wire rod and the steel wire was a tensile direction, and tensile tests were conducted under a rate of 10 mm/min. Average values of the tensile strength (TS) and the reduction of area (RA) were determined from results of at least three times of the tests. A case in which the tensile strength (TS) was 1200 MPa or more and a case in which the reduction of area (RA) was 45% were judged to be acceptable.

Occurrence of Delamination

Occurrence of delamination was evaluated by using the steel wire after the wire-drawing. When the diameter of the steel wire was d, the steel wire after the wire-rolling was subjected to a torsion test by using a torsion testing machine under conditions such that a gauge length was 100×d and a rotational speed was 10 rpm. In addition, at least three times of the torsion tests were conducted. A case in which the at least one occurrence of the delamination was confirmed by visual observation was regarded as "occurred", and a case in which the occurrence of the delamination was not confirmed was regarded as "not occurred". The delamination "not occurred" was judged to be acceptable.

The production results and the evaluation results are shown in Tables 1 to 4. In Nos. 1 to 48 that were examples, the steel wire rods had excellent strength and ductility. In addition, in the steel wires that were wire-drawn from the steel wire rod, the strength was high strength, and the occurrence of delamination was suppressed.

On the other hand, in Nos. 49 to 85 that were comparative examples, the steel wire rods were out of the range of the present invention. In the steel wires that were wire-drawn from the steel wire rod, the occurrence of delamination was confirmed.

In Comparative Example 49, the amount of Al+Ti was excessive, and thus RA of the steel wire rod was insufficient. In Comparative Example 50, the amount of Cr was excessive, and thus the fraction of the pearlite of the steel wire rod was insufficient. In Comparative Example 51, the amount of Co was excessive, a large amount of expensive element was contained, and the cost increased. In Comparative Example 52, the amount of V was excessive, and thus RA of the steel wire rod was insufficient. In Comparative Example 53, the amount of Cu was excessive, and thus RA of the steel wire rod was insufficient. In Comparative Example 54, the amount of Nb was excessive, and thus the fraction of the pearlite of the steel wire rod was insufficient. In Comparative Example 55, the amount of Mo was excessive, and thus the fraction of the pearlite of the steel wire rod was insufficient. In Comparative Example 56, the amount of W was excessive, and thus the fraction of the pearlite of the steel wire rod was insufficient. In Comparative Example 57, the amount of B was excessive, and thus RA of the steel wire rod was insufficient. In Comparative Example 58, the amount of REM was excessive, and thus RA of the steel wire rod was insufficient. In Comparative Example 59, the amount of Ca was excessive, and thus RA of the steel wire rod was insufficient. In Comparative Example 60, the amount of Mg was excessive, and thus RA of the steel wire rod was insufficient. In Comparative Example 61, the amount of Zr was excessive, and thus RA of the steel wire rod was insufficient.

In Comparative Example 62, the amount of C was insufficient, and thus TS and RA of the steel wire rod were insufficient. In Comparative Example 63, the amount of C was excessive, and thus RA of the steel wire rod was insufficient.

In Comparative Example 64, the amount of Si was insufficient, and thus TS and RA of the steel wire rod were insufficient. In Comparative Example 65, the amount of Si was excessive, and thus RA of the steel wire rod was insufficient.

In Comparative Example 66, the amount of Mn was insufficient, and thus TS and RA of the steel wire rod were insufficient. In Comparative Example 67, the amount of Mn was excessive, and thus RA of the steel wire rod was insufficient.

In Comparative Example 68, the amount of N was insufficient, and thus the average PBS at the central portion of the steel wire rod and the average PBS at the surface layer portion of the steel wire rod were insufficient. In Comparative Example 69, the amount of N was excessive, and thus RA of the steel wire rod was insufficient.

In Comparative Example 70, the amount of Ni was insufficient, and thus the average PBS at the central portion of the steel wire rod, the average PBS at the surface layer portion of the steel wire rod, and the minimum lamellar spacing at the central portion of the steel wire rod were insufficient. In Comparative Example 71, the amount of Ni was excessive, and thus RA of the steel wire rod was insufficient.

In Comparative Example 72, the amount of Al was insufficient, and thus the average PBS at the central portion of the steel wire rod and the average PBS at the surface layer portion of the steel wire rod were insufficient. In Comparative Example 73, the amount of Al was excessive, and thus RA of the steel wire rod was insufficient.

In Comparative Example 74, the amount of Ti was insufficient, and thus the average PBS at the central portion of the steel wire rod and the average PBS at the surface layer portion of the steel wire rod were insufficient. In Comparative Example 75, the amount of Ti was excessive, and thus RA of the steel wire rod was insufficient.

In Comparative Example 76, the heating temperature in the heating process was low, and thus the fraction of the pearlite of the steel wire rod was insufficient. In Comparative Example 77, the heating temperature in the heating process was high, and thus the average PBS at the central portion of the steel wire rod and the average PBS at the surface layer portion of the steel wire rod were insufficient.

In Comparative Example 78, the reduction of the finish rolling in the hot-rolling process was small, and thus the average PBS at the central portion of the steel wire rod and the average PBS at the surface layer portion of the steel wire rod were insufficient.

In Comparative Example 79, the finishing rolling temperature in the hot-rolling process was low, and thus the fraction of the pearlite of the steel wire rod was insufficient. In Comparative Example 80, the finishing rolling temperature in the hot-rolling process was high, and thus the average PBS at the central portion of the steel wire rod and the average PBS at the surface layer portion of the steel wire rod were insufficient.

In Comparative Example 81, the coiling temperature in the coiling process was low, and thus the fraction of the pearlite of the steel wire rod was insufficient. In Comparative Example 82, the coiling temperature in the coiling process was high, and thus the average PBS at the central portion of the steel wire rod and the average PBS at the surface layer portion of the steel wire rod were insufficient.

In Comparative Example 83, a time after the coiling process before the patenting process was long, and thus the fraction of the pearlite of the steel wire rod, the average PBS at the central portion of the steel wire rod, and the average PBS at the surface layer portion of the steel wire rod were insufficient.

In Comparative Example 84, the temperature of the molten salt in the patenting process was low, and thus the fraction of the pearlite of the steel wire rod was insufficient. In Comparative Example 85, the temperature of the molten salt in the patenting process was high, and thus the minimum lamellar spacing at the central portion of the steel wire rod was insufficient.

TABLE 1

| | | CHEMICAL COMPOSITION (mass %) | | | | | | | | | | | |
|---|---|---|---|---|---|---|---|---|---|---|---|---|---|
| | No. | C | Si | Mn | P | S | O | Al | Ti | N | Cr | Mo | Ni |
| Example | 1 | 0.72 | 0.33 | 0.79 | 0.011 | 0.013 | 0.0024 | 0.023 | | 0.0032 | | | 0.023 |
| | 2 | 0.71 | 0.32 | 0.80 | 0.010 | 0.012 | 0.0022 | | 0.026 | 0.0033 | | | 0.023 |
| | 3 | 0.71 | 0.32 | 0.79 | 0.011 | 0.011 | 0.0025 | 0.023 | 0.025 | 0.0031 | | | 0.023 |
| | 4 | 0.73 | 0.31 | 0.77 | 0.011 | 0.013 | 0.0024 | 0.024 | 0.026 | 0.0031 | 0.12 | | 0.022 |
| | 5 | 0.72 | 0.33 | 0.79 | 0.011 | 0.013 | 0.0024 | 0.024 | 0.027 | 0.0032 | | | 0.022 |
| | 6 | 0.71 | 0.33 | 0.79 | 0.012 | 0.012 | 0.0023 | 0.022 | 0.025 | 0.0033 | | | 0.022 |
| | 7 | 0.73 | 0.32 | 0.78 | 0.010 | 0.013 | 0.0023 | 0.022 | 0.025 | 0.0033 | | | 0.022 |
| | 8 | 0.73 | 0.31 | 0.78 | 0.010 | 0.012 | 0.0023 | 0.022 | 0.024 | 0.0033 | | | 0.023 |
| | 9 | 0.74 | 0.32 | 0.79 | 0.011 | 0.013 | 0.0025 | 0.021 | 0.024 | 0.0031 | | 0.04 | 0.023 |
| | 10 | 0.71 | 0.33 | 0.78 | 0.011 | 0.013 | 0.0024 | 0.025 | 0.026 | 0.0032 | | | 0.023 |
| | 11 | 0.72 | 0.32 | 0.80 | 0.013 | 0.011 | 0.0024 | 0.023 | 0.025 | 0.0031 | | | 0.024 |
| | 12 | 0.72 | 0.32 | 0.79 | 0.011 | 0.011 | 0.0025 | 0.023 | 0.024 | 0.0032 | | | 0.023 |
| | 13 | 0.73 | 0.31 | 0.80 | 0.012 | 0.013 | 0.0024 | 0.024 | 0.026 | 0.0031 | | | 0.024 |
| | 14 | 0.72 | 0.32 | 0.77 | 0.010 | 0.012 | 0.0022 | 0.023 | 0.025 | 0.0033 | | | 0.022 |
| | 15 | 0.73 | 0.32 | 0.79 | 0.011 | 0.013 | 0.0024 | 0.021 | 0.026 | 0.0032 | | | 0.024 |
| | 16 | 0.71 | 0.15 | 0.11 | 0.003 | 0.011 | 0.0005 | 0.006 | 0.042 | 0.0049 | 0.45 | 0.18 | 0.005 |
| | 17 | 0.72 | 0.18 | 0.79 | 0.011 | 0.013 | 0.0024 | 0.023 | 0.025 | 0.0032 | 0.18 | 0.057 | 0.049 |
| | 18 | 0.72 | 0.17 | 0.99 | 0.013 | 0.014 | 0.0029 | 0.048 | 0.048 | 0.0010 | 0.0011 | 0.056 | 0.034 |
| | 19 | 0.72 | 0.31 | 0.12 | 0.014 | 0.006 | 0.0023 | 0.044 | 0.005 | 0.0024 | 0.0012 | 0.0051 | 0.010 |
| | 20 | 0.72 | 0.30 | 0.79 | 0.006 | 0.019 | 0.0028 | 0.092 | 0.005 | 0.0046 | 0.19 | 0.0052 | 0.006 |
| | 21 | 0.71 | 0.32 | 0.99 | 0.019 | 0.014 | 0.0006 | 0.032 | 0.033 | 0.0033 | 0.21 | 0.058 | 0.009 |
| | 22 | 0.72 | 0.34 | 0.11 | 0.014 | 0.013 | 0.0024 | 0.094 | 0.005 | 0.0012 | 0.14 | 0.023 | 0.023 |
| | 23 | 0.71 | 0.35 | 0.78 | 0.013 | 0.012 | 0.0029 | 0.005 | 0.092 | 0.0021 | 0.13 | 0.032 | 0.007 |
| | 24 | 0.72 | 0.34 | 0.98 | 0.012 | 0.009 | 0.0023 | 0.046 | 0.005 | 0.0025 | 0.098 | 0.059 | 0.006 |
| | 25 | 0.72 | 0.59 | 0.11 | 0.009 | 0.004 | 0.0022 | 0.045 | 0.049 | 0.0030 | 0.19 | 0.055 | 0.029 |
| | 26 | 0.72 | 0.58 | 0.79 | 0.004 | 0.013 | 0.0024 | 0.035 | 0.013 | 0.0028 | 0.47 | 0.052 | 0.006 |
| | 27 | 0.72 | 0.59 | 0.98 | 0.013 | 0.003 | 0.0024 | 0.036 | 0.043 | 0.0039 | 0.48 | 0.057 | 0.030 |
| | 28 | 0.81 | 0.17 | 0.99 | 0.013 | 0.014 | 0.0029 | 0.048 | 0.048 | 0.0010 | 0.0011 | 0.056 | 0.034 |
| | 29 | 0.80 | 0.31 | 0.12 | 0.014 | 0.006 | 0.0023 | 0.044 | 0.005 | 0.0024 | 0.0012 | 0.0051 | 0.010 |
| | 30 | 0.79 | 0.30 | 0.79 | 0.006 | 0.019 | 0.0028 | 0.092 | 0.006 | 0.0046 | 0.19 | 0.0052 | 0.006 |
| | 31 | 0.82 | 0.34 | 0.11 | 0.014 | 0.013 | 0.0024 | 0.094 | 0.005 | 0.0012 | 0.14 | 0.023 | 0.023 |
| | 32 | 0.81 | 0.35 | 0.78 | 0.013 | 0.012 | 0.0029 | 0.005 | 0.092 | 0.0021 | 0.13 | 0.032 | 0.007 |
| | 33 | 0.84 | 0.34 | 0.98 | 0.012 | 0.009 | 0.0023 | 0.046 | 0.005 | 0.0025 | 0.098 | 0.059 | 0.006 |
| | 34 | 0.88 | 0.34 | 0.11 | 0.014 | 0.013 | 0.0024 | 0.094 | 0.005 | 0.0012 | 0.0011 | 0.056 | 0.034 |
| | 35 | 0.89 | 0.35 | 0.78 | 0.013 | 0.012 | 0.0029 | 0.005 | 0.092 | 0.0021 | 0.0012 | 0.0051 | 0.010 |
| | 36 | 0.88 | 0.34 | 0.98 | 0.012 | 0.009 | 0.0023 | 0.046 | 0.010 | 0.0025 | 0.19 | 0.0052 | 0.006 |
| | 37 | 0.89 | 0.17 | 0.99 | 0.013 | 0.014 | 0.0029 | 0.048 | 0.048 | 0.0010 | 0.14 | 0.023 | 0.023 |
| | 38 | 0.89 | 0.31 | 0.12 | 0.014 | 0.006 | 0.0023 | 0.044 | 0.005 | 0.0024 | 0.13 | 0.032 | 0.067 |
| | 39 | 0.88 | 0.30 | 0.79 | 0.006 | 0.019 | 0.0028 | 0.092 | 0.006 | 0.0045 | 0.098 | 0.059 | 0.006 |
| | 40 | 0.85 | 0.31 | 0.12 | 0.014 | 0.006 | 0.0024 | 0.094 | 0.005 | 0.0012 | 0.0011 | 0.0052 | 0.006 |
| | 41 | 0.98 | 0.30 | 0.79 | 0.006 | 0.019 | 0.0025 | 0.005 | 0.092 | 0.0021 | 0.0012 | 0.0011 | 0.010 |
| | 42 | 0.97 | 0.34 | 0.98 | 0.012 | 0.009 | 0.0024 | 0.094 | 0.005 | 0.0012 | 0.0011 | 0.056 | 0.034 |
| | 43 | 0.99 | 0.17 | 0.99 | 0.013 | 0.014 | 0.0029 | 0.005 | 0.092 | 0.0021 | 0.0012 | 0.059 | 0.006 |

| | No. | Cu | V | Co | W | Nb | B | Mg | Ca | REM | Zr | Al + Ti |
|---|---|---|---|---|---|---|---|---|---|---|---|---|
| Example | 1 | | | | | | | | | | | 0.023 |
| | 2 | | | | | | | | | | | 0.026 |
| | 3 | | | | | | | | | | | 0.048 |
| | 4 | | | | | | | | | | | 0.050 |
| | 5 | | | 0.1300 | | | | | | | | 0.051 |
| | 6 | | 0.120 | | | | | | | | | 0.047 |
| | 7 | 0.12 | | | | | | | | | | 0.047 |
| | 8 | | | | | 0.050 | | | | | | 0.047 |
| | 9 | | | | | | | | | | | 0.045 |

TABLE 1-continued

| | CHEMICAL COMPOSITION (mass %) | | | | | | | | | | |
|---|---|---|---|---|---|---|---|---|---|---|---|
| 10 | | | | 0.0700 | | | | | | | 0.051 |
| 11 | | | | | | 0.0010 | | | | | 0.048 |
| 12 | | | | | | | | | 0.0020 | | 0.047 |
| 13 | | | | | | | | 0.0020 | | | 0.050 |
| 14 | | | | | | | 0.0015 | | | | 0.046 |
| 15 | | | | | | | | | | 0.0020 | 0.047 |
| 16 | 0.0011 | 0.48 | 0.0900 | 0.0008 | 0.056 | 0.0004 | 0.0012 | 0.0010 | 0.0038 | 0.0005 | 0.048 |
| 17 | 0.0012 | 0.090 | 0.1500 | 0.0580 | 0.055 | 0.0008 | 0.0048 | 0.0039 | 0.0014 | 0.0006 | 0.049 |
| 18 | 0.16 | 0.150 | 0.0013 | 0.0230 | 0.052 | 0.0028 | 0.0005 | 0.0006 | 0.0012 | 0.0011 | 0.096 |
| 19 | 0.09 | 0.0013 | 0.0014 | 0.0320 | 0.057 | 0.0015 | 0.0006 | 0.0008 | 0.0048 | 0.0010 | 0.049 |
| 20 | 0.15 | 0.0014 | 0.1700 | 0.0590 | 0.090 | 0.0014 | 0.0011 | 0.0028 | 0.0005 | 0.0039 | 0.098 |
| 21 | 0.0013 | 0.179 | 0.1800 | 0.0550 | 0.057 | 0.0012 | 0.0010 | 0.0038 | 0.0006 | 0.0005 | 0.065 |
| 22 | 0.0014 | 0.180 | 0.0600 | 0.0520 | 0.056 | 0.0011 | 0.0039 | 0.0014 | 0.0011 | 0.0008 | 0.099 |
| 23 | 0.17 | 0.060 | 0.1700 | 0.0570 | 0.0051 | 0.0005 | 0.0006 | 0.0012 | 0.0010 | 0.0028 | 0.097 |
| 24 | 0.18 | 0.170 | 0.1800 | 0.1800 | 0.0052 | 0.0006 | 0.0006 | 0.0048 | 0.0039 | 0.0038 | 0.051 |
| 25 | 0.06 | 0.180 | 0.3400 | 0.0570 | 0.058 | 0.0011 | 0.0028 | 0.0005 | 0.0004 | 0.0014 | 0.094 |
| 26 | 0.17 | 0.34 | 0.2300 | 0.0560 | 0.023 | 0.0610 | 0.0038 | 0.0006 | 0.0008 | 0.0012 | 0.048 |
| 27 | 0.18 | 0.23 | 0.4800 | 0.0051 | 0.032 | 0.0012 | 0.0014 | 0.0011 | 0.0028 | 0.0048 | 0.049 |
| 28 | 0.16 | 0.150 | 0.0013 | 0.0230 | 0.052 | 0.0028 | 0.0005 | 0.0006 | 0.0012 | 0.0011 | 0.096 |
| 29 | 0.09 | 0.0013 | 0.0014 | 0.0320 | 0.057 | 0.0024 | 0.0006 | 0.0008 | 0.0048 | 0.0010 | 0.049 |
| 30 | 0.15 | 0.0014 | 0.1700 | 0.0590 | 0.090 | 0.0014 | 0.0011 | 0.0028 | 0.0005 | 0.0039 | 0.098 |
| 31 | 0.0014 | 0.180 | 0.0600 | 0.0520 | 0.056 | 0.0011 | 0.0039 | 0.0014 | 0.0011 | 0.0006 | 0.099 |
| 32 | 0.17 | 0.050 | 0.1700 | 0.0570 | 0.0051 | 0.0005 | 0.0006 | 0.0012 | 0.0010 | 0.0028 | 0.097 |
| 33 | 0.18 | 0.170 | 0.1800 | 0.1800 | 0.0052 | 0.0006 | 0.0008 | 0.0048 | 0.0039 | 0.0098 | 0.051 |
| 34 | 0.16 | 0.150 | 0.0013 | 0.0230 | 0.052 | 0.0026 | 0.0006 | 0.0006 | 0.0012 | 0.0011 | 0.099 |
| 35 | 0.09 | 0.0013 | 0.0014 | 0.0320 | 0.057 | 0.0015 | 0.0006 | 0.0008 | 0.0048 | 0.0010 | 0.097 |
| 36 | 0.15 | 0.0014 | 0.1700 | 0.0590 | 0.090 | 0.0014 | 0.0011 | 0.0028 | 0.0005 | 0.0039 | 0.056 |
| 37 | 0.0005 | 0.180 | 0.0600 | 0.0520 | 0.056 | 0.0011 | 0.0038 | 0.0014 | 0.0011 | 0.0006 | 0.098 |
| 38 | 0.17 | 0.080 | 0.1700 | 0.0570 | 0.0051 | 0.0005 | 0.0006 | 0.0012 | 0.0010 | 0.0028 | 0.049 |
| 39 | 0.18 | 0.176 | 0.1800 | 0.1800 | 0.0052 | 0.0006 | 0.0008 | 0.0048 | 0.0039 | 0.0038 | 0.098 |
| 40 | 0.15 | 0.0014 | 0.1700 | 0.0590 | 0.090 | 0.0014 | 0.0011 | 0.0028 | 0.0005 | 0.0039 | 0.099 |
| 41 | 0.09 | 0.0013 | 0.0014 | 0.0320 | 0.057 | 0.0015 | 0.0008 | 0.0008 | 0.0048 | 0.0010 | 0.097 |
| 42 | 0.16 | 0.150 | 0.0013 | 0.0230 | 0.052 | 0.0028 | 0.0005 | 0.0006 | 0.0012 | 0.0011 | 0.099 |
| 43 | 0.18 | 0.170 | 0.1800 | 0.1800 | 0.0052 | 0.0006 | 0.0008 | 0.0048 | 0.0039 | 0.0038 | 0.097 |

TABLE 2

| | | CHEMICAL COMPOSITION (mass %) | | | | | | | | | | | |
|---|---|---|---|---|---|---|---|---|---|---|---|---|---|
| | No. | C | Si | Mn | P | S | O | Al | Ti | N | Cr | Mo | Ni |
| Example | 44 | 0.98 | 0.34 | 0.11 | 0.014 | 0.013 | 0.0023 | 0.044 | 0.005 | 0.0024 | 0.13 | 0.032 | 0.007 |
| | 45 | 0.97 | 0.35 | 0.78 | 0.013 | 0.012 | 0.0028 | 0.092 | 0.006 | 0.0046 | 0.098 | 0.023 | 0.023 |
| | 46 | 0.89 | 0.31 | 0.98 | 0.025 | 0.013 | 0.0024 | 0.094 | 0.006 | 0.0012 | 0.0011 | 0.056 | 0.034 |
| | 47 | 0.88 | 0.30 | 0.11 | 0.013 | 0.024 | 0.0029 | 0.005 | 0.013 | 0.0021 | 0.0012 | 0.0051 | 0.010 |
| | 48 | 0.96 | 0.34 | 0.78 | 0.014 | 0.019 | 0.0034 | 0.046 | 0.043 | 0.0025 | 0.19 | 0.0052 | 0.006 |
| Comparative Example | 49 | 0.89 | 0.17 | 0.78 | 0.014 | 0.019 | 0.0023 | 0.054 | 0.051 | 0.0025 | 0.098 | 0.059 | 0.006 |
| | 50 | 0.98 | 0.35 | 0.98 | 0.006 | 0.014 | 0.0023 | 0.094 | 0.005 | 0.0010 | 0.51 | 0.023 | 0.023 |
| | 51 | 0.87 | 0.34 | 0.99 | 0.014 | 0.013 | 0.0028 | 0.005 | 0.005 | 0.0021 | 0.13 | 0.032 | 0.007 |
| | 52 | 0.88 | 0.34 | 0.12 | 0.013 | 0.012 | 0.0006 | 0.046 | 0.006 | 0.0025 | 0.098 | 0.059 | 0.006 |
| | 53 | 0.89 | 0.35 | 0.79 | 0.012 | 0.009 | 0.0024 | 0.046 | 0.005 | 0.0012 | 0.0011 | 0.056 | 0.034 |
| | 54 | 0.89 | 0.34 | 0.78 | 0.014 | 0.004 | 0.0029 | 0.044 | 0.005 | 0.0021 | 0.0012 | 0.0051 | 0.010 |
| | 55 | 0.88 | 0.17 | 0.98 | 0.013 | 0.013 | 0.0023 | 0.006 | 0.048 | 0.0046 | 0.19 | 0.23 | 0.006 |
| | 56 | 0.96 | 0.31 | 0.11 | 0.012 | 0.003 | 0.0022 | 0.046 | 0.006 | 0.0012 | 0.14 | 0.032 | 0.007 |
| | 57 | 0.98 | 0.30 | 0.78 | 0.013 | 0.014 | 0.0024 | 0.094 | 0.005 | 0.0021 | 0.13 | 0.0051 | 0.010 |
| | 58 | 0.97 | 0.31 | 0.98 | 0.014 | 0.006 | 0.0024 | 0.005 | 0.005 | 0.0025 | 0.10 | 0.056 | 0.034 |
| | 59 | 0.82 | 0.30 | 0.99 | 0.014 | 0.019 | 0.0029 | 0.046 | 0.048 | 0.0012 | 0.0011 | 0.032 | 0.007 |
| | 60 | 0.81 | 0.35 | 0.12 | 0.006 | 0.013 | 0.0024 | 0.048 | 0.043 | 0.0021 | 0.0012 | 0.059 | 0.006 |
| | 61 | 0.84 | 0.34 | 0.79 | 0.014 | 0.004 | 0.0024 | 0.005 | 0.048 | 0.0025 | 0.19 | 0.0052 | 0.006 |
| | 62 | 0.68 | 0.31 | 0.12 | 0.014 | 0.006 | 0.0023 | 0.044 | 0.005 | 0.0024 | 0.0012 | 0.0051 | 0.010 |
| | 63 | 1.02 | 0.30 | 0.79 | 0.006 | 0.019 | 0.0028 | 0.092 | 0.006 | 0.0046 | 0.19 | 0.0052 | 0.006 |
| | 64 | 0.80 | 0.12 | 0.12 | 0.014 | 0.006 | 0.0023 | 0.044 | 0.005 | 0.0024 | 0.0012 | 0.0051 | 0.010 |
| | 65 | 0.79 | 0.64 | 0.79 | 0.006 | 0.019 | 0.0028 | 0.092 | 0.006 | 0.0046 | 0.19 | 0.0062 | 0.006 |
| | 66 | 0.72 | 0.17 | 0.08 | 0.013 | 0.019 | 0.0023 | 0.045 | 0.013 | 0.0024 | 0.13 | 0.032 | 0.007 |
| | 67 | 0.81 | 0.31 | 1.08 | 0.014 | 0.014 | 0.0026 | 0.035 | 0.043 | 0.0046 | 0.098 | 0.059 | 0.006 |
| | 68 | 0.80 | 0.30 | 0.98 | 0.006 | 0.013 | 0.0006 | 0.006 | 0.048 | 0.0009 | 0.0011 | 0.0052 | 0.006 |
| | 69 | 0.79 | 0.32 | 0.11 | 0.014 | 0.012 | 0.0024 | 0.048 | 0.005 | 0.0053 | 0.0012 | 0.0051 | 0.010 |
| | 70 | 0.82 | 0.34 | 0.79 | 0.013 | 0.009 | 0.0029 | 0.044 | 0.006 | 0.0025 | 0.098 | 0.059 | 0.0047 |
| | 71 | 0.81 | 0.35 | 0.98 | 0.012 | 0.004 | 0.0023 | 0.092 | 0.005 | 0.0030 | 0.19 | 0.055 | 0.051 |
| | 72 | 0.84 | 0.34 | 0.99 | 0.014 | 0.013 | 0.0022 | 0.0046 | 0.005 | 0.0024 | 0.0012 | 0.0051 | 0.010 |
| | 73 | 0.88 | 0.59 | 0.12 | 0.013 | 0.003 | 0.0024 | 0.11 | 0.048 | 0.0046 | 0.19 | 0.0052 | 0.006 |
| | 74 | 0.89 | 0.58 | 0.79 | 0.012 | 0.014 | 0.0024 | 0.005 | 0.0046 | 0.0012 | 0.14 | 0.023 | 0.023 |
| | 75 | 0.88 | 0.59 | 0.11 | 0.013 | 0.006 | 0.0029 | 0.048 | 0.11 | 0.0021 | 0.13 | 0.032 | 0.007 |
| | 76 | 0.72 | 0.17 | 0.99 | 0.013 | 0.014 | 0.0029 | 0.048 | 0.05 | 0.001 | 0.0011 | 0.058 | 0.034 |
| | 77 | 0.72 | 0.31 | 0.12 | 0.014 | 0.006 | 0.0023 | 0.044 | 0.01 | 0.0024 | 0.0012 | 0.0051 | 0.010 |

TABLE 2-continued

| CHEMICAL COMPOSITION (mass %) | | | | | | | | | | | | |
|---|---|---|---|---|---|---|---|---|---|---|---|---|
| 78 | 0.81 | 0.17 | 0.99 | 0.013 | 0.014 | 0.0029 | 0.048 | 0.05 | 0.001 | 0.0011 | 0.056 | 0.034 |
| 79 | 0.84 | 0.34 | 0.98 | 0.012 | 0.009 | 0.0023 | 0.046 | 0.01 | 0.0025 | 0.098 | 0.059 | 0.006 |
| 80 | 0.88 | 0.34 | 0.11 | 0.014 | 0.013 | 0.0024 | 0.094 | 0.01 | 0.0012 | 0.0011 | 0.056 | 0.034 |
| 81 | 0.88 | 0.34 | 0.98 | 0.012 | 0.009 | 0.0023 | 0.046 | 0.01 | 0.0025 | 0.19 | 0.0052 | 0.006 |
| 82 | 0.89 | 0.17 | 0.99 | 0.013 | 0.014 | 0.0029 | 0.048 | 0.05 | 0.001 | 0.14 | 0.023 | 0.023 |
| 83 | 0.96 | 0.31 | 0.12 | 0.014 | 0.006 | 0.0024 | 0.094 | 0.01 | 0.0012 | 0.0011 | 0.0052 | 0.006 |
| 84 | 0.98 | 0.30 | 0.79 | 0.006 | 0.019 | 0.0029 | 0.005 | 0.09 | 0.0021 | 0.0012 | 0.0051 | 0.010 |
| 85 | 0.97 | 0.34 | 0.98 | 0.012 | 0.009 | 0.0024 | 0.094 | 0.01 | 0.0012 | 0.0011 | 0.056 | 0.034 |

| | No. | Cu | V | Co | W | Nb | B | Mg | Ca | REM | Zr | Al + Ti |
|---|---|---|---|---|---|---|---|---|---|---|---|---|
| Example | 44 | 0.17 | 0.060 | 0.1700 | 0.570 | 0.0005 | 0.0005 | 0.0006 | 0.0012 | 0.0010 | 0.0028 | 0.049 |
| | 45 | 0.0014 | 0.180 | 0.0600 | 0.0520 | 0.056 | 0.0011 | 0.0039 | 0.0014 | 0.0011 | 0.0008 | 0.098 |
| | 46 | 0.16 | 0.150 | 0.0013 | 0.0230 | 0.052 | 0.0028 | 0.0005 | 0.0006 | 0.0012 | 0.0011 | 0.100 |
| | 47 | 0.09 | 0.0013 | 0.0014 | 0.0320 | 0.059 | 0.0015 | 0.0006 | 0.0008 | 0.0048 | 0.0010 | 0.018 |
| | 48 | 0.15 | 0.0014 | 0.1700 | 0.0580 | 0.080 | 0.0014 | 0.0011 | 0.0028 | 0.0005 | 0.0039 | 0.089 |
| Comparative Example | 49 | 0.18 | 0.170 | 0.1800 | 0.1800 | 0.0052 | 0.0006 | 0.008 | 0.0048 | 0.0039 | 0.0038 | 0.105 |
| | 50 | 0.0014 | 0.180 | 0.0600 | 0.0520 | 0.056 | 0.0011 | 0.0039 | 0.0014 | 0.0011 | 0.0008 | 0.099 |
| | 51 | 0.18 | 0.170 | 0.53 | 0.520 | 0.056 | 0.0011 | 0.0038 | 0.0014 | 0.0011 | 0.0008 | 0.010 |
| | 52 | 0.09 | 0.53 | 0.0013 | 0.0570 | 0.0051 | 0.0005 | 0.0006 | 0.0012 | 0.0010 | 0.0029 | 0.052 |
| | 53 | 0.22 | 0.170 | 0.1800 | 0.1800 | 0.0052 | 0.0006 | 0.0008 | 0.0048 | 0.0039 | 0.0038 | 0.053 |
| | 54 | 0.17 | 0.060 | 0.1700 | 0.0570 | 0.11 | 0.0014 | 0.0011 | 0.0028 | 0.005 | 0.0039 | 0.049 |
| | 55 | 0.15 | 0.0014 | 0.1700 | 0.0582 | 0.090 | 0.0015 | 0.0006 | 0.0008 | 0.0048 | 0.0010 | 0.054 |
| | 56 | 0.17 | 0.060 | 0.1700 | 0.23 | 0.056 | 0.0028 | 0.0005 | 0.0006 | 0.0012 | 0.0011 | 0.052 |
| | 57 | 0.09 | 0.0013 | 0.0014 | 0.0320 | 0.057 | 0.0034 | 0.0039 | 0.0014 | 0.001 | 0.0039 | 0.089 |
| | 58 | 0.16 | 0.150 | 0.0013 | 0.0230 | 0.052 | 0.0028 | 0.0005 | 0.0006 | 0.0055 | 0.0008 | 0.010 |
| | 59 | 0.17 | 0.060 | 0.1700 | 0.0571 | 0.0051 | 0.006 | 0.006 | 0.0054 | 0.0012 | 0.0008 | 0.094 |
| | 60 | 0.1800 | 0.170 | 0.1822 | 0.1800 | 0.0052 | 0.0006 | 0.0053 | 0.0028 | 0.0005 | 0.0028 | 0.091 |
| | 61 | 0.1500 | 0.001 | 0.1700 | 0.0582 | 0.09 | 0.0014 | 0.0006 | 0.0008 | 0.0048 | 0.0110 | 0.053 |
| | 62 | 0.0900 | 0.001 | 0.0014 | 0.0320 | 0.057 | 0.0015 | 0.0006 | 0.0008 | 0.0048 | 0.0010 | 0.049 |
| | 63 | 0.1500 | 0.0014 | 0.1700 | 0.0590 | 0.09 | 0.0014 | 0.0011 | 0.0028 | 0.0005 | 0.0039 | 0.098 |
| | 64 | 0.09 | 0.0013 | 0.0614 | 0.0320 | 0.057 | 0.0015 | 0.0006 | 0.0008 | 0.0048 | 0.0010 | 0.049 |
| | 65 | 0.15 | 0.0014 | 0.1700 | 0.0590 | 0.090 | 0.0014 | 0.0011 | 0.0028 | 0.0005 | 0.0038 | 0.098 |
| | 66 | 0.1700 | 0.060 | 0.1700 | 0.0570 | 0.0051 | 0.0005 | 0.0006 | 0.0012 | 0.0010 | 0.0028 | 0.058 |
| | 67 | 0.1800 | 0.170 | 0.1800 | 0.1800 | 0.0052 | 0.0006 | 0.0006 | 0.0046 | 0.0039 | 0.0038 | 0.078 |
| | 68 | 0.15 | 0.0014 | 0.1700 | 0.0590 | 0.090 | 0.0014 | 0.0011 | 0.0028 | 0.0005 | 0.0039 | 0.054 |
| | 69 | 0.09 | 0.0013 | 0.0014 | 0.0320 | 0.057 | 0.0015 | 0.0008 | 0.0008 | 0.0048 | 0.0010 | 0.053 |
| | 70 | 0.16 | 0.150 | 0.0013 | 0.0230 | 0.052 | 0.0028 | 0.0005 | 0.0006 | 0.0012 | 0.0011 | 0.060 |
| | 71 | 0.18 | 0.170 | 0.1800 | 0.1800 | 0.0052 | 0.0006 | 0.0008 | 0.0048 | 0.0038 | 0.0038 | 0.097 |
| | 72 | 0.09 | 0.0013 | 0.0014 | 0.0320 | 0.057 | 0.0015 | 0.0006 | 0.0008 | 0.0048 | 0.0010 | 0.010 |
| | 73 | 0.15 | 0.0014 | 0.1700 | 0.0590 | 0.090 | 0.0014 | 0.0011 | 0.0028 | 0.0005 | 0.0039 | 0.158 |
| | 74 | 0.0014 | 0.180 | 0.0600 | 0.520 | 0.056 | 0.0011 | 0.0039 | 0.0014 | 0.0014 | 0.0008 | 0.010 |
| | 75 | 0.17 | 0.060 | 0.1700 | 0.0570 | 0.0051 | 0.0005 | 0.0006 | 0.0012 | 0.0010 | 0.0028 | 0.158 |
| | 76 | 0.16 | 0.150 | 0.0013 | 0.0230 | 0.052 | 0.0028 | 0.0005 | 0.0006 | 0.0012 | 0.0011 | 0.096 |
| | 77 | 0.09 | 0.001 | 0.0014 | 0.0320 | 0.057 | 0.0015 | 0.0006 | 0.0008 | 0.0048 | 0.0010 | 0.049 |
| | 78 | 0.16 | 0.150 | 0.0013 | 0.230 | 0.052 | 0.0028 | 0.0005 | 0.0006 | 0.0012 | 0.0011 | 0.096 |
| | 79 | 0.18 | 0.170 | 0.1800 | 0.1800 | 0.0052 | 0.0006 | 0.0008 | 0.0048 | 0.0039 | 0.0038 | 0.051 |
| | 80 | 0.16 | 0.150 | 0.0013 | 0.020 | 0.052 | 0.0028 | 0.0005 | 0.0006 | 0.0012 | 0.0011 | 0.099 |
| | 81 | 0.15 | 0.001 | 0.1700 | 0.0580 | 0.09 | 0.0014 | 0.0011 | 0.0028 | 0.0005 | 0.0039 | 0.051 |
| | 82 | 0.0014 | 0.180 | 0.0600 | 0.0520 | 0.056 | 0.0011 | 0.0039 | 0.0014 | 0.0011 | 0.0008 | 0.096 |
| | 83 | 0.15 | 0.001 | 0.1700 | 0.0590 | 0.09 | 0.0014 | 0.0011 | 0.0028 | 0.0005 | 0.0039 | 0.099 |
| | 84 | 0.09 | 0.001 | 0.0014 | 0.0320 | 0.057 | 0.0015 | 0.0006 | 0.0008 | 0.0048 | 0.0010 | 0.097 |
| | 85 | 0.16 | 0.150 | 0.0013 | 0.0230 | 0.052 | 0.0028 | 0.0005 | 0.0006 | 0.0012 | 0.0011 | 0.099 |

TABLE 3

| PRODUCTION CONDITIONS | | | | | | | | | |
|---|---|---|---|---|---|---|---|---|---|
| | | (1) | 3 | | | (7) | (9) | | |
| | No. | (2) (° C.) | (4) (%) | (5) (° C.) | (6) (um) | (8) (° C.) | (10) | (11) | (12) (° C.) |
| Example | 1 | 1026 | 21 | 901 | 9.0 | 795 | 7 | DLP | 530 |
| | 2 | 1023 | 20 | 901 | 9.0 | 790 | 6 | DLP | 535 |
| | 3 | 1022 | 21 | 900 | 9.0 | 785 | 8 | DLP | 530 |
| | 4 | 1028 | 22 | 900 | 9.0 | 790 | 7 | DLP | 530 |
| | 5 | 1028 | 22 | 902 | 9.0 | 790 | 9 | DLP | 525 |
| | 6 | 1025 | 21 | 908 | 9.0 | 795 | 8 | DLP | 530 |
| | 7 | 1026 | 22 | 900 | 9.0 | 765 | 7 | DLP | 530 |
| | 8 | 1026 | 21 | 901 | 9.0 | 795 | 7 | DLP | 530 |
| | 9 | 1028 | 20 | 903 | 9.0 | 785 | 8 | DLP | 525 |
| | 10 | 1025 | 21 | 901 | 9.0 | 790 | 7 | DLP | 530 |
| | 11 | 1022 | 23 | 902 | 9.0 | 785 | 8 | DLP | 535 |
| | 12 | 1026 | 22 | 800 | 9.0 | 780 | 6 | DLP | 530 |

TABLE 3-continued

| PRODUCTION CONDITIONS | | | | | | | | |
|---|---|---|---|---|---|---|---|---|
| 13 | 1025 | 22 | 801 | 9.0 | 785 | 6 | DLP | 530 |
| 14 | 1026 | 21 | 803 | 9.0 | 785 | 7 | DLP | 535 |
| 15 | 1023 | 20 | 801 | 9.0 | 795 | 7 | DLP | 530 |
| 16 | 1001 | 36 | 851 | 5.5 | 795 | 5 | DLP | 540 |
| 17 | 1002 | 32 | 875 | 10.0 | 840 | 15 | DLP | 530 |
| 18 | 1024 | 27 | 888 | 12.5 | 780 | 5 | DLP | 550 |
| 19 | 1025 | 15 | 900 | 5.5 | 795 | 6 | DLP | 580 |
| 20 | 1026 | 21 | 901 | 9.0 | 795 | 7 | DLP | 480 |
| 21 | 1048 | 25 | 924 | 12.0 | 795 | 8 | DLP | 550 |
| 22 | 1050 | 52 | 925 | 10.0 | 790 | 4 | DLP | 550 |
| 23 | 1051 | 29 | 926 | 12.0 | 840 | 14 | DLP | 560 |
| 24 | 1074 | 28 | 948 | 12.5 | 820 | 18 | DLP | 545 |
| 25 | 1075 | 48 | 950 | 12.0 | 795 | 6 | DLP | 580 |
| 26 | 1076 | 31 | 851 | 12.0 | 786 | 5 | DLP | 550 |
| 27 | 1086 | 23 | 975 | 12.5 | 825 | 12 | DLP | 535 |
| 28 | 1088 | 56 | 896 | 11.0 | 780 | 5 | DLP | 540 |
| 29 | 1002 | 33 | 852 | 9.5 | 795 | 5 | DLP | 540 |
| 30 | 1003 | 33 | 876 | 10.0 | 840 | 15 | DLP | 530 |
| 31 | 1025 | 25 | 900 | 12.5 | 780 | 8 | DLP | 550 |
| 32 | 1026 | 16 | 901 | 535 | 795 | 8 | DLP | 580 |
| 33 | 1027 | 22 | 902 | 9.0 | 795 | 7 | DLP | 450 |
| 34 | 1050 | 26 | 925 | 12.0 | 795 | 8 | DLP | 550 |
| 35 | 1051 | 53 | 926 | 10.0 | 790 | 4 | DLP | 560 |
| 36 | 1052 | 30 | 927 | 12.0 | 840 | 14 | DLP | 580 |
| 37 | 1075 | 29 | 950 | 12.5 | 820 | 13 | DLP | 545 |
| 38 | 1076 | 49 | 951 | 12.0 | 795 | 8 | DLP | 580 |
| 39 | 1077 | 32 | 952 | 12.0 | 780 | 5 | DLP | 550 |
| 40 | 1099 | 24 | 976 | 12.5 | 825 | 12 | DLP | 535 |
| 41 | 1099 | 59 | 999 | 11.0 | 790 | 5 | DLP | 540 |
| 42 | 1002 | 37 | 852 | 5.5 | 795 | 5 | DLP | 540 |
| 43 | 1003 | 33 | 876 | 10.0 | 840 | 15 | DLP | 530 |

| | | (13) | | | | | | | | | | | |
|---|---|---|---|---|---|---|---|---|---|---|---|---|---|
| | | (14) | | | | | (22) | | | (27) | | | |
| | | | (16) | | (19) | | | (24) | | (28) | | (31) | |
| | No. | (15) (%) | (17) (μm) | (18) (μm) | (20) (nm) | (21) | (23) (MPa) | (25) (%) | (26) | (29) (mm) | (30) | (32) | (33) (MPa) |
| Example | 1 | 95.1 | 22.5 | 19.7 | 113 | 119 | 1225 | 45 | 44.9 | 3.0 | 2.20 | (34) | 2225 |
| | 2 | 95.2 | 22.8 | 19.8 | 113 | 119 | 1228 | 45 | 44.8 | 3.0 | 2.20 | (34) | 2227 |
| | 3 | 95.2 | 20.5 | 18.6 | 113 | 119 | 1238 | 46 | 43.5 | 3.0 | 2.20 | (34) | 2282 |
| | 4 | 85.2 | 20.4 | 18.7 | 100 | 119 | 1322 | 46 | 40.9 | 3.0 | 2.20 | (34) | 2035 |
| | 5 | 95.1 | 20.0 | 18.9 | 113 | 119 | 1251 | 48 | 43.7 | 3.0 | 2.20 | (34) | 2283 |
| | 6 | 85.1 | 18.3 | 17.4 | 113 | 119 | 1204 | 47 | 61.3 | 3.0 | 2.20 | (34) | 2316 |
| | 7 | 95.0 | 20.6 | 18.5 | 113 | 119 | 1253 | 46 | 43.6 | 3.0 | 2.20 | (34) | 2264 |
| | 8 | 95.5 | 14.9 | 14.5 | 113 | 119 | 1231 | 48 | 62.4 | 3.0 | 2.20 | (34) | 2298 |
| | 9 | 97.1 | 19.9 | 18.7 | 113 | 119 | 1301 | 48 | 61.5 | 3.0 | 2.20 | (34) | 2313 |
| | 10 | 97.2 | 19.7 | 18.8 | 113 | 119 | 1305 | 48 | 61.4 | 3.0 | 2.20 | (34) | 2315 |
| | 11 | 97.0 | 18.3 | 17.4 | 113 | 119 | 1314 | 48 | 60.9 | 3.0 | 2.20 | (34) | 2322 |
| | 12 | 96.1 | 20.3 | 19.0 | 113 | 119 | 1262 | 48 | 63.7 | 3.0 | 2.20 | (34) | 2282 |
| | 13 | 95.2 | 19.9 | 18.7 | 113 | 119 | 1275 | 48 | 62.6 | 3.0 | 2.20 | (34) | 2285 |
| | 14 | 95.0 | 18.7 | 18.8 | 113 | 119 | 1276 | 48 | 42.5 | 3.0 | 2.20 | (34) | 2287 |
| | 15 | 95.1 | 19.8 | 18.7 | 113 | 119 | 1275 | 48 | 62.8 | 3.0 | 2.20 | (34) | 2284 |
| | 16 | 95.1 | 9.8 | 9.3 | 93 | 88 | 1380 | 50 | 37.9 | 1.5 | 2.60 | (34) | 2323 |
| | 17 | 95.2 | 15.4 | 14.1 | 119 | 123 | 1222 | 47 | 45.0 | 2.8 | 2.55 | (34) | 2219 |
| | 18 | 95.8 | 4.2 | 4.0 | 133 | 140 | 1304 | 55 | 41.3 | 3.0 | 2.65 | (34) | 2337 |
| | 19 | 97.7 | 15.3 | 14.5 | 93 | 88 | 1643 | 49 | 25.8 | 1.5 | 2.60 | (34) | 2484 |
| | 20 | 97.7 | 8.7 | 8.3 | 113 | 119 | 1252 | 51 | 43.8 | 3.0 | 2.20 | (34) | 2159 |
| | 21 | 97.7 | 10.3 | 9.8 | 130 | 137 | 1286 | 52 | 42.1 | 3.8 | 2.30 | (34) | 2179 |
| | 22 | 99.1 | 7.2 | 6.8 | 119 | 125 | 1445 | 54 | 35.5 | 3.0 | 2.41 | (34) | 2285 |
| | 23 | 88.5 | 19.9 | 18.9 | 139 | 137 | 1315 | 45 | 40.7 | 4.0 | 2.20 | (34) | 2252 |
| | 24 | 98.1 | 17.6 | 16.7 | 133 | 140 | 1385 | 47 | 38.6 | 4.5 | 2.04 | (34) | 2265 |
| | 25 | 88.5 | 18.3 | 17.4 | 139 | 137 | 1395 | 48 | 37.2 | 3.8 | 2.30 | (34) | 2107 |
| | 26 | 97.7 | 3.5 | 3.3 | 130 | 157 | 1380 | 56 | 379 | 3.8 | 2.50 | (34) | 2218 |
| | 27 | 96.5 | 17.0 | 16.2 | 133 | 140 | 1365 | 47 | 38.0 | 4.5 | 2.00 | (34) | 2108 |
| | 28 | 96.3 | 12.4 | 11.8 | 124 | 101 | 1427 | 47 | 35.8 | 4.0 | 2.02 | (34) | 2115 |
| | 29 | 95.1 | 9.8 | 9.3 | 93 | 98 | 1380 | 50 | 37.0 | 1.5 | 2.80 | (34) | 2023 |
| | 30 | 95.2 | 21.1 | 20.0 | 119 | 125 | 1222 | 47 | 45.0 | 2.3 | 2.55 | (34) | 2216 |
| | 31 | 85.8 | 4.2 | 4.0 | 133 | 140 | 1304 | 55 | 41.3 | 3.0 | 2.85 | (34) | 2337 |
| | 32 | 97.7 | 15.3 | 14.5 | 93 | 95 | 1649 | 49 | 25.8 | 1.5 | 2.60 | (34) | 2484 |
| | 33 | 87.7 | 8.7 | 8.3 | 113 | 119 | 1252 | 51 | 43.6 | 3.0 | 2.20 | (34) | 2159 |
| | 34 | 97.7 | 10.8 | 9.8 | 130 | 107 | 1288 | 52 | 42.1 | 3.8 | 2.30 | (34) | 2179 |
| | 35 | 99.1 | 7.2 | 6.5 | 119 | 125 | 1445 | 54 | 35.9 | 3.0 | 2.41 | (34) | 2285 |
| | 36 | 98.5 | 19.9 | 18.9 | 130 | 137 | 1318 | 48 | 60.7 | 4.0 | 2.20 | (34) | 2252 |
| | 37 | 98.1 | 17.8 | 16.7 | 133 | 140 | 1365 | 47 | 38.8 | 4.5 | 2.04 | (34) | 2205 |

TABLE 3-continued

| PRODUCTION CONDITIONS | | | | | | | | | | | | |
|---|---|---|---|---|---|---|---|---|---|---|---|---|
| 38 | 98.8 | 18.3 | 17.4 | 130 | 137 | 1395 | 48 | 37.2 | 3.8 | 2.30 | (34) | 2107 |
| 39 | 97.7 | 3.8 | 3.2 | 130 | 137 | 1380 | 56 | 39.9 | 3.8 | 2.30 | (34) | 2218 |
| 40 | 96.5 | 17.0 | 18.2 | 133 | 140 | 1365 | 47 | 38.6 | 4.5 | 2.04 | (34) | 2103 |
| 41 | 96.3 | 12.4 | 11.8 | 124 | 131 | 1427 | 47 | 35.8 | 4.0 | 2.02 | (34) | 2115 |
| 42 | 95.1 | 9.8 | 9.3 | 93 | 98 | 1380 | 50 | 37.9 | 1.5 | 2.60 | (34) | 2323 |
| 43 | 95.2 | 21.1 | 20.0 | 119 | 123 | 1222 | 47 | 45.0 | 2.8 | 2.55 | (34) | 2219 |

(1) HEATING PROCESS
(2) HEATING TEMPERATURE
(3) HOT-ROLL PROCESS
(4) ROLLING REDUCTION IN FINISH ROLLING
(5) FINISHING ROLLING TEMPERATURE
(6) DIAMETER 2 r AFTER FINISH ROLLING
(7) COILING PROCESS
(8) COILING TEMPERATURE
(9) PATENTING PROCESS
(10) TIME AFTER COILING (sec.)
(11) PATENTING METHOD
(12) TEMPERATURE OF MOLTEN SALT
(13) EVALUATION RESULTS OF STEEL WIRE ROD
(14) METALLOGRAPHIC STRUCTURE
(15) FRACTION OF PEARLITE
(16) AVERAGE PEARLITE BLOCK SIZE
(17) CENTRAL PORTION
(18) SURFACE LAYER PORTION
(19) LAMELLAR SPACING
(20) MINIMUM LAMELLAR SPACING AT CENTRAL PORTION
(21) VALUE OF (12 r + 65)
(22) MECHANICAL PROPERTIES
(23) TENSILE STRENGTH TS
(24) REDUCTION OF AREA
(25) REDUCTION OF AREA RA
(26) VALUE OF (100-0.045 x TS)
(27) STEEL WIRE AFTER WIRE-DRAWING
(28) PRODUCTION CONDITIONS
(29) DIAMETER AFTER WIRE-DRAWING
(30) STRAIN DURING WIRE-DRAWING
(31) EVALUTION RESULTS
(32) OCCURRENCE OF DELAMINATION
(33) TENSILE STRENGTH TS
(34) NOT OCCURED

TABLE 4

| PRODUCTION CONDITIONS | | | | | | | | | |
|---|---|---|---|---|---|---|---|---|---|
| | | (1) | (3) | | | (7) | (9) | | |
| | No. | (2) (° C.) | (4) (%) | (5) (° C.) | (6) (mm) | (8) (° C.) | (10) | (11) | (12) (° C.) |
| Example | 44 | 1025 | 28 | 900 | 12.5 | 780 | 3 | DLP | 550 |
| | 45 | 1026 | 16 | 901 | 5.5 | 795 | 6 | DLP | 580 |
| | 46 | 1050 | 26 | 825 | 12.0 | 795 | 8 | DLP | 550 |
| | 47 | 1051 | 53 | 926 | 10.0 | 790 | 4 | DLP | 580 |
| | 48 | 1052 | 30 | 927 | 12.0 | 840 | 14 | DLP | 580 |
| | 49 | 1027 | 22 | 902 | 9.0 | 705 | 7 | DLP | 480 |
| Example | 50 | 1075 | 29 | 950 | 12.5 | 820 | 13 | DLP | 545 |
| Comparative | 51 | 1076 | 49 | 951 | 12.0 | 795 | 6 | DLP | 580 |
| | 52 | 1077 | 32 | 952 | 12.0 | 780 | 5 | DLP | 550 |
| | 53 | 1089 | 24 | 976 | 12.5 | 825 | 12 | DLP | 535 |
| | 54 | 1099 | 59 | 999 | 11.0 | 790 | 5 | DLP | 540 |
| | 55 | 1003 | 37 | 878 | 5.5 | 840 | 15 | DLP | 530 |
| | 56 | 1025 | 33 | 900 | 10.0 | 780 | 3 | DLP | 550 |
| | 57 | 1026 | 28 | 901 | 12.5 | 795 | 6 | DLP | 580 |
| | 58 | 1027 | 16 | 902 | 5.5 | 795 | 7 | DLP | 480 |
| | 59 | 1050 | 22 | 925 | 9.0 | 795 | 8 | DLP | 550 |
| | 60 | 1051 | 26 | 928 | 12.0 | 790 | 4 | DLP | 580 |
| | 61 | 1052 | 53 | 927 | 10.0 | 840 | 14 | DLP | 560 |
| | 62 | 1001 | 36 | 851 | 5.5 | 795 | 5 | DLP | 540 |

TABLE 4-continued

| PRODUCTION CONDITIONS | | | | | | | | |
|---|---|---|---|---|---|---|---|---|
| 63 | 1002 | 32 | 875 | 10.0 | 840 | 15 | DLP | 530 |
| 64 | 1024 | 27 | 899 | 12.5 | 780 | 3 | DLP | 550 |
| 65 | 1025 | 15 | 900 | 5.5 | 795 | 6 | DLP | 580 |
| 66 | 1026 | 21 | 901 | 9.0 | 795 | 7 | DLP | 480 |
| 67 | 1049 | 25 | 924 | 12.0 | 795 | 8 | DLP | 550 |
| 68 | 1050 | 52 | 925 | 100 | 790 | 4 | DLP | 560 |
| 69 | 1051 | 29 | 926 | 12.0 | 840 | 14 | DLP | 560 |
| 70 | 1074 | 28 | 949 | 12.5 | 820 | 13 | DLP | 545 |
| 71 | 1075 | 48 | 950 | 12.0 | 795 | 6 | DLP | 580 |
| 72 | 1076 | 31 | 951 | 12.0 | 780 | 5 | DLP | 550 |
| 73 | 1058 | 23 | 975 | 12.5 | 825 | 12 | DLP | 535 |
| 74 | 1099 | 58 | 999 | 11.0 | 790 | 5 | DLP | 540 |
| 75 | 1002 | 37 | 852 | 5.5 | 795 | 5 | DLP | 540 |
| 76 | 995 | 22 | 904 | 10.0 | 795 | 7 | (36) | — |
| 77 | 1104 | 26 | 927 | 12.5 | 755 | — | (37) | 575 |
| 78 | 1027 | 8 | 928 | 5.5 | 790 | 5 | (36) | — |
| 79 | 1029 | 29 | 945 | 12.0 | 820 | 5 | (36) | — |
| 80 | 1052 | 49 | 1003 | 10.0 | 795 | 10 | (36) | — |
| 81 | 1053 | 32 | 954 | 12.0 | 778 | 6 | (36) | — |
| 82 | 1054 | 24 | 978 | 12.5 | 845 | — | (37) | 579 |
| 83 | 1077 | 59 | 995 | 12.0 | 780 | 17 | (36) | — |
| 84 | 1025 | 15 | 900 | 5.5 | 795 | 6 | DLP | 470 |
| 85 | 1026 | 21 | 901 | 9.0 | 795 | 7 | DLP | 600 |

| | | (13) | | | | | | | | | | | |
|---|---|---|---|---|---|---|---|---|---|---|---|---|---|
| | | (14) | | | | | (22) | | | (27) | | | |
| | | | (16) | | (19) | | | (24) | | (28) | | (31) | |
| | No. | (15) (%) | (17) (μm) | (18) (μm) | (20) (nm) | (21) | (23) (MPa) | (25) (%) | (26) | (29) (mm) | (30) | (32) | (33) (MPa) |
| Example | 44 | 95.8 | 4.2 | 4.0 | 133 | 140 | 1304 | 55 | 41.3 | 3.0 | 2.85 | (34) | 2337 |
| | 45 | 97.7 | 16.8 | 14.6 | 93 | 98 | 1849 | 49 | 25.6 | 1.5 | 2.80 | (34) | 2484 |
| | 46 | 87.7 | 10.3 | 9.8 | 130 | 137 | 1286 | 45 | 42.1 | 3.8 | 2.30 | (34) | 2179 |
| | 47 | 90.1 | 7.2 | 5.8 | 112 | 125 | 1445 | 46 | 35.0 | 3.0 | 2.48 | (34) | 2285 |
| | 48 | 88.5 | 19.9 | 18.9 | 130 | 137 | 1318 | 46 | 40.7 | 4.0 | 2.20 | (34) | 2252 |
| | 49 | 87.7 | 8.7 | 8.3 | 113 | 119 | 1252 | 44 | 43.6 | 3.0 | 2.20 | (35) | 2159 |
| Example | 50 | 84.2 | 17.4 | 16.7 | 133 | 140 | 1182 | 44 | 45.8 | 4.5 | 2.04 | (35) | 2205 |
| Comparative | 51 | 98.8 | 18.3 | 17.4 | 130 | 137 | 1095 | 46 | 37.2 | 3.8 | 2.30 | (34) | 2107 |
| | 52 | 97.7 | 3.5 | 3.3 | 130 | 137 | 1980 | 49 | 37.9 | 3.8 | 2.30 | (35) | 2218 |
| | 53 | 98.5 | 17.9 | 16.2 | 133 | 140 | 1385 | 41 | 38.6 | 4.5 | 2.04 | (35) | 2103 |
| | 54 | 94.8 | 12.4 | 11.8 | 124 | 138 | 1197 | 44 | 46.1 | 4.0 | 2.02 | (35) | 2115 |
| | 55 | 94.2 | 9.8 | 8.3 | 83 | 98 | 1192 | 44 | 46.4 | 1.5 | 2.60 | (35) | 2323 |
| | 56 | 94.0 | 21.1 | 20.0 | 119 | 125 | 1185 | 49 | 46.7 | 2.8 | 2.55 | (35) | 2219 |
| | 57 | 95.8 | 4.2 | 4.0 | 93 | 140 | 1304 | 43 | 41.3 | 3.0 | 2.85 | (35) | 2337 |
| | 58 | 97.7 | 15.3 | 14.5 | 93 | 98 | 1548 | 42 | 25.6 | 1.5 | 2.80 | (35) | 2484 |
| | 59 | 97.7 | 8.7 | 8.3 | 113 | 119 | 1252 | 44 | 43.6 | 3.0 | 2.20 | (35) | 2159 |
| | 60 | 87.7 | 10.3 | 9.8 | 119 | 137 | 1255 | 42 | 42.3 | 3.8 | 2.30 | (35) | 2179 |
| | 61 | 89.1 | 7.2 | 5.8 | 119 | 125 | 1445 | 42 | 35.0 | 3.0 | 2.42 | (35) | 2285 |
| | 62 | 85.1 | 9.8 | 9.3 | 93 | 98 | 1100 | 44 | 50.5 | 1.5 | 2.80 | (35) | 2323 |
| | 63 | 95.2 | 21.1 | 20.0 | 119 | 125 | 1222 | 39 | 45.0 | 2.8 | 2.55 | (35) | 2219 |
| | 64 | 95.8 | 4.2 | 4.0 | 133 | 140 | 1115 | 44 | 49.8 | 3.0 | 2.85 | (35) | 2337 |
| | 65 | 97.7 | 15.3 | 14.5 | 93 | 88 | 1600 | 26 | 28.3 | 1.5 | 2.80 | (35) | 2484 |
| | 66 | 97.7 | 8.7 | 8.3 | 113 | 119 | 1175 | 44 | 47.1 | 3.0 | 2.20 | (35) | 2159 |
| | 67 | 97.7 | 10.3 | 9.8 | 130 | 137 | 1280 | 39 | 42.1 | 3.8 | 2.30 | (35) | 2179 |
| | 68 | 89.1 | 26.5 | 25.5 | 119 | 125 | 1445 | 37 | 35.0 | 3.0 | 2.41 | (35) | 2288 |
| | 69 | 98.5 | 19.9 | 18.9 | 130 | 137 | 1318 | 38 | 40.7 | 4.0 | 2.20 | (35) | 2252 |
| | 70 | 98.1 | 25.9 | 25.6 | 166 | 140 | 1165 | 37 | 47.6 | 4.5 | 2.04 | (35) | 2205 |
| | 71 | 98.8 | 18.3 | 17.4 | 130 | 137 | 1395 | 42 | 37.2 | 3.8 | 2.30 | (35) | 2187 |
| | 72 | 87.7 | 26.5 | 25.3 | 130 | 137 | 1380 | 37 | 37.5 | 3.8 | 2.30 | (23) | 2218 |
| | 73 | 86.5 | 17.0 | 16.2 | 133 | 140 | 1305 | 39 | 36.0 | 4.5 | 2.04 | (35) | 2103 |
| | 74 | 96.3 | 28.4 | 25.8 | 124 | 131 | 1427 | 36 | 35.8 | 4.0 | 2.02 | (35) | 2115 |
| | 75 | 95.1 | 9.8 | 9.3 | 93 | 98 | 1380 | 39 | 37.9 | 1.5 | 2.60 | (35) | 2323 |
| | 76 | 83.1 | 22.1 | 19.9 | 119 | 125 | 1113 | 38 | 49.9 | 2.8 | 2.55 | (35) | 2316 |
| | 77 | 95.5 | 29.3 | 28.6 | 133 | 140 | 1304 | 38 | 41.3 | 3.0 | 2.85 | (35) | 2212 |
| | 78 | 96.3 | 28.6 | 25.7 | 93 | 98 | 1649 | 32 | 25.8 | 1.5 | 2.60 | (35) | 2330 |
| | 79 | 92.5 | 6.3 | 6.0 | 130 | 137 | 1186 | 39 | 46.6 | 3.8 | 2.36 | (35) | 2153 |
| | 80 | 95.6 | 26.9 | 25.6 | 119 | 125 | 1445 | 30 | 35.0 | 3.0 | 2.41 | (35) | 2172 |
| | 81 | 93.2 | 13.5 | 12.8 | 130 | 137 | 1119 | 37 | 49.7 | 4.0 | 2.26 | (35) | 2278 |

TABLE 4-continued

| PRODUCTION CONDITIONS | | | | | | | | | | | | |
|---|---|---|---|---|---|---|---|---|---|---|---|---|
| 82 | 87.7 | 26.2 | 24.9 | 133 | 140 | 1365 | 38 | 38.6 | 4.5 | 2.04 | (35) | 2245 |
| 83 | 92.1 | 25.9 | 25.6 | 130 | 137 | 1195 | 36 | 46.2 | 3.8 | 2.36 | (25) | 2198 |
| 84 | 92.7 | 15.3 | 14.5 | 93 | 98 | 1178 | 30 | 47.0 | 1.5 | 2.00 | (35) | 2216 |
| 85 | 97.7 | 8.7 | 8.3 | 179 | 119 | 1128 | 38 | 49.2 | 3.0 | 2.20 | (35) | 1981 |

(1) HEATING PROCESS
(2) HEATING TEMPERATURE
(3) HOT-ROLLING PROCESS
(4) ROLLING REDUCTION IN FINISH ROOLING
(5) FINISHING ROLLING TEMPERATURE
(6) DIAMETER 2 R AFTER FINISH ROLLING
(7) COILING PROCESS
(8) COILING TEMPERATURE
(9) PATENTING PROCESS
(10) TIME AFTER COILING (sec.)
(11) PATENTING METHOD
(12) TEMPERATURE OF MOLTEN SALT
(36) STELMOR
(37) REHEAT LP
(13) ELALUATION RESULTS OF STEEL WIRE ROD
(14) METALLOGRAPHIC STRUCTURE
(15) FRACTION OF PEARLLITE
(16) AVERAGE PEARLITE BLOCK SIZE
(17) CENTRAL PORTION
(18) SURFACE LAYER PORTION
(19) LAMELLAR SPACING
(20) MINIMUM LAMELLAR SPACING AT CENTRAL PORTION
(21) VALUE OF (12 r + 65)
(22) MECHANICAL PROPERTIES
(23) TENSILE STRENGTH TS
(24) REDUCTION OF AREA
(25) REDUCTION OF AREA RA
(26) VALUE OF (100-0.045 × TS)
(27) STEEL WIRE AFTER WIRE-DRAWING
(28) PRODUCTION CONDITIONS
(29) DIAMETER AFTER WIRE-DRAWING
(30) STRAIN DURING WIRE-DRAWING
(31) EVALUATION RESULTS
(32) OCCURRENCE OF SELAMINATION
(33) TENSILE STRENGTH TS
(34) NOT OCCURES
(35) OCCURRED

INDUSTRIAL APPLICABILITY

According to the aspects of the present invention, it is possible to obtain a steel wire rod having higher strength and better ductility than those of the conventional one without adding expensive elements. As a result, it is possible to produce a steel wire in which the occurrence of delamination is suppressed and in which strength is high. Accordingly, the present invention has significant industrial applicability.

The invention claimed is:

1. A steel wire rod having a diameter of 5.5 mm to 12.5 mm after finish rolling consisting of, as a chemical composition, by mass %:

0.70% to 1.00% of C;
0.15% to 0.35% of Si;
0.1% to 1.0% of Mn;
0.001% to 0.005% of N;
0.005% to less than 0.050% of Ni;
at least one of 0.005% to 0.10% of Al or 0.005% to 0.10% of Ti;
at least one of
more than 0% to 0.50% of Cr,
more than 0% to 0.50% of Co,
more than 0% to 0.50% of V,
more than 0% to 0.20% of Cu,
more than 0% to 0.10% of Nb,
more than 0% to 0.20% of Mo,
more than 0% to 0.0020% of W,
more than 0% to 0.0050% of Rare Earth Metal,
more than 0.0005% to 0.0050% of Ca,
more than 0.0005% to 0.0050% of Mg, or
more than 0.0005% to 0.010% of Zr; and
a balance consisting of iron and unavoidable impurities, and
as a metallographic structure, by area %, 95% to 100% of a pearlite,
wherein, when a distance from a peripheral surface to a center is r in unit of mm, an average pearlite block size at a central portion which is an area from the center to r×0.99 is 1 μm to 25 μm,
an average pearlite block size at a surface layer portion which is an area from the peripheral surface to r×0.01 is 1 μm to 20 μm,
when a minimum lamellar spacing of the pearlite at the central portion is S in unit of nm, a following Expression 1 is satisfied,
wherein the steel wire rod has a tensile strength of 1200 MPa or more, and
the tensile strength, TS in unit of MPa, and a reduction of area, RA in unit of %, satisfy a following Expression 2 and a following Expression 3, and
amounts expressed in mass % of each element in the chemical composition satisfy a following Expression 4, $$S<12r+65 \quad \text{(Expression 1)}$$

$$RA\geq 100-0.045\times TS \quad \text{(Expression 2)}$$

$RA \geq 45$ (Expression 3)

$0.005 \leq Al+Ti \leq 0.1$ (Expression 4).

2. A method of producing a steel wire rod, the method comprising:

a casting process to obtain a cast piece consisting of the chemical composition according to claim 1;

a heating process of heating the cast piece to a temperature of 1000° C. to 1100° C.;

a hot-rolling process of hot-finish-rolling the cast piece after the heating process by controlling a finishing temperature to be 850° C. to 1000° C. to obtain a hot-rolled steel;

a coiling process of coiling the hot-rolled steel within a temperature range of 780° C. to 840° C.;

a patenting process of directly immersing the hot-rolled steel after the coiling process in a molten salt, which is held at a temperature of 480° C. to 580° C., within 15 seconds after the coiling process; and a cooling process of cooling the hot-rolled steel after the patenting process to a room temperature to obtain the steel wire rod.

* * * * *